US011152676B2

(12) United States Patent
Iwanaka

(10) Patent No.: US 11,152,676 B2
(45) Date of Patent: Oct. 19, 2021

(54) TUNABLE BAND-PASS FILTER AND CONTROL METHOD THEREFOR

(71) Applicant: NEC CORPORATION, Tokyo (JP)

(72) Inventor: Daisuke Iwanaka, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 17/042,362

(22) PCT Filed: Feb. 18, 2019

(86) PCT No.: PCT/JP2019/005726
§ 371 (c)(1),
(2) Date: Sep. 28, 2020

(87) PCT Pub. No.: WO2019/187761
PCT Pub. Date: Oct. 3, 2019

(65) Prior Publication Data

US 2021/0028525 A1 Jan. 28, 2021

(30) Foreign Application Priority Data

Mar. 29, 2018 (JP) ..... JP2018-063980

(51) Int. Cl.
*H01P 1/207* (2006.01)
*H01P 7/06* (2006.01)
(Continued)

(52) U.S. Cl.
CPC ..... *H01P 1/207* (2013.01); *H01P 1/203* (2013.01); *H01P 1/2053* (2013.01); *H01P 7/06* (2013.01)

(58) Field of Classification Search
CPC ..... H01P 1/202; H01P 1/203; H01P 1/20336; H01P 1/205; H01P 1/2053; H01P 1/207;
(Continued)

(56) References Cited

U.S. PATENT DOCUMENTS 4,761,625 A 8/1988 Sharma
2012/0126914 A1* 5/2012 Miyamoto ..... H01P 1/207 333/209
2017/0288289 A1 10/2017 Zhao et al.

FOREIGN PATENT DOCUMENTS

JP 2001-060805 A 3/2001
WO 2017/170120 A1 10/2017

OTHER PUBLICATIONS

Fermin Mira et al., "Mechanical Tuning of Substrate Integrated Waveguide Filters", IEEE Transactions on Microwave Theory and Techniques, Dec. 2015, pp. 3939-3946, vol. 63, No. 12.
(Continued)

*Primary Examiner* — Stephen E. Jones
(74) *Attorney, Agent, or Firm* — Sughrue Mion, PLLC

(57) ABSTRACT

A tunable band-pass filter (10) according to the present disclosure includes: a waveguide (11); a plurality of resonators (121) configured to be accommodated in the waveguide (11) and aligned in a longitudinal direction of the waveguide (11); a dielectric plate (13) configured to extend in the longitudinal direction of the waveguide (11) so to be arranged adjacent to the plurality of resonators (121); and a metal pattern (15) for coupling adjustment formed on the dielectric plate (13) at a position corresponding to an interstage of the resonators (121), in which a distance between the dielectric plate (13) and the resonators (121) is variable.

7 Claims, 20 Drawing Sheets

(51) Int. Cl.
*H01P 1/203* (2006.01)
*H01P 1/205* (2006.01)

(58) Field of Classification Search
CPC .... H01P 7/04; H01P 7/08; H01P 7/082; H01P 7/088; H01P 7/00; H01P 7/06
USPC ..... 333/203, 205, 206, 207, 209, 202, 208
See application file for complete search history.

(56) References Cited

OTHER PUBLICATIONS

International Search Report for PCT/JP2019/005726 dated Apr. 23, 2019 [PCT/ISA/210].

* cited by examiner

TUNABLE BAND-PASS FILTER AND CONTROL METHOD THEREFOR

CROSS REFERENCE TO RELATED APPLICATIONS

This application is a National Stage of International Application No. PCT/JP2019/005726 filed Feb. 18, 2019, claiming priority based on Japanese Patent Application No. 2018-063980 filed Mar. 29, 2018, the disclosure of which is incorporated herein in its entirety by reference.

TECHNICAL FIELD

The present disclosure relates to a tunable band-pass filter and a control method therefor.

BACKGROUND ART

In a communication device that performs transmission/reception using a microwave frequency band and a millimeter-wave band, a band-pass filter is used in order to allow only a signal in a desired frequency band to pass through it and to remove unnecessary frequency components. Recently, there has been an increasing demand to change the passband of a band-pass filter from the outside. Hereinbelow, an example of a tunable band-pass filter whose passband can be changed from the outside will be described.

FIGS. 1 and 2 are diagrams each showing an example of a configuration of a tunable band-pass filter 100 according to a related art, FIG. 1 being a perspective view and FIG. 2 being a bottom view.

As shown in FIGS. 1 and 2, the tunable band-pass filter 100 according to the related art includes a waveguide 11, a metal plate 12, a dielectric plate 130, and a support rod 14. Note that the tunable band-pass filter 100 is a filter called a semi-coaxial filter or an evanescent mode filter.

The waveguide 11 is a conductive rectangular waveguide. The waveguide 11 is divided into two members along a horizontal plane, and the plate-like metal plate 12 is held between these two members.

The metal plate 12 is formed of a plate-like conductor and extends in the longitudinal direction (the x-direction) of the waveguide 11. Three resonance plates 121-1 to 121-3 and two input/output ports 122-1 and 122-2 are formed to the metal plate 12. Hereinbelow, when the resonance plates 121-1 to 121-3 are referred to without any particular distinction being made, they may be simply referred to as the "resonance plates 121". Similarly, the input/output ports 122-1 and 122-2 may be simply referred to as the "input/output ports 122".

The tunable band-pass filter 100 according to the related art is a three-stage band-pass filter that includes three resonance plates 121-1 to 121-3. Note that the number of stages of the tunable band-pass filter 100 is not limited to three, and may be any number as long as it is two or more.

The resonance plates 121-1 to 121-3 are plate-like resonators having respective one ends thereof (the positive y-direction side) connected to the metal plate 12 and respective other ends thereof (the negative y-direction side) being open ends (that is, they are not connected to other members). The resonance plates 121-1 to 121-3 are accommodated in the waveguide 11 and are aligned in the longitudinal direction (the x-direction) of the waveguide 11 so that the side surfaces of the resonance plates 121 face each other. The resonance plates 121-1 to 121-3 operate to resonate at a resonance frequency determined by the shape, the length (the y-direction) and the like.

The input/output ports 122-1 to 122-2 are ports for inputting and outputting high-frequency signals. The input/output port 122-1 is connected to the resonance plate 121-1 by electromagnetic coupling, and the input/output port 122-2 is connected to the resonance plate 121-3 by electromagnetic coupling. One of the input/output ports 122-1 and 122-2 operates as an input port and the other operates as an output port. For example, when the input/output port 122-1 operates as the input port and the input/output port 122-2 operates as the output port, a high-frequency signal is input to the input/output port 122-1, and regarding the input high-frequency signal, only a high-frequency signal which is within the passband of the tunable band-pass filter 100 is output from the input/output port 122-2.

The dielectric plate 130 is formed of a plate-like dielectric. The dielectric plate 130 extends in the longitudinal direction (the x-direction) of the waveguide 11 and is arranged adjacent to the resonance plates 121-1 to 121-3 so that a main surface (a surface having the largest area) of the dielectric plate 130 faces the main surfaces of the resonance plates 121-1 to 121-3.

The support rods 14-1 and 14-2 are attached to both ends of the dielectric plate 130 in the x-direction, respectively. The dielectric plate 130 can be moved in the vertical direction (the z-direction) by displacing the support rods 14-1 and 14-2 in the vertical direction (that is, the z-direction perpendicular to the main surface of the dielectric plate 130) using a stepping motor (not shown) provided outside the tunable band-pass filter 100. Thus, the distance between the dielectric plate 130 and the resonance plates 121-1 to 121-3 is variable.

When the center frequency of the passband is changed, the tunable band-pass filter 100 according to the related art moves the dielectric plate 130 in the vertical direction (the z-direction). For example, the further the dielectric plate 130 recedes from the resonance plates 121-1 to 121-3 (the more the dielectric plate 130 moves upward (the positive z-direction)), the higher the center frequency of the passband becomes. Conversely, the closer the dielectric plate 130 approaches the resonance plates 121-1 to 121-3 (the more the dielectric plate 130 moves downward (the negative z-direction)), the lower the center frequency of the passband becomes.

A tunable band-pass filter in which a dielectric plate is arranged so that the main surface of the dielectric plate faces the main surface of the resonator and the center frequency of the passband is changed by moving the dielectric plate, like the tunable band-pass filter 100 according to the related art shown in FIGS. 1 and 2, is disclosed in, for example, Patent Literatures 1 and 2.

In the tunable band-pass filter disclosed in Patent Literature 1, the center frequency of the passband is changed by moving the dielectric plate in a direction perpendicular to and parallel to the main surface of the dielectric plate.

In the tunable band-pass filter disclosed in Patent Literature 2, the center frequency of the passband is changed by moving a tuning piece in a direction parallel to the main surface of the tuning piece corresponding to the dielectric plate and varying the positional relationship between a metal sheet formed in the tuning piece and a window formed in a metal plate corresponding to the metal plate.

CITATION LIST

Patent Literatures

Patent Literature 1: International Patent Publication No. WO 2017/170120

Patent Literature 2: United States Patent Publication No., 2017/0288289

SUMMARY OF INVENTION

Technical Problem

However, in the tunable band-pass filter 100 according to the related art shown in FIGS. 1 and 2, there is a problem that the bandwidth of the passband fluctuates largely when the center frequency of the passband is changed. This problem will be described in detail below.

FIGS. 3 to 5 are diagrams showing examples in which the passing waveforms of the tunable band-pass filter 100 according to the related art shown in FIGS. 1 and 2 are simulated, and in the diagrams, the horizontal axis represents the frequency [GHz] and the vertical axis represents the passing loss [dB]. FIGS. 3, 4 and 5 show the passing waveforms when the center frequency of the passband is 10.6 [GHz], 11.0 [GHz] and 11.4 [GHz], respectively. FIG. 6 is a diagram in which the three passing waveforms shown in FIGS. 3 to 5 are superimposed so that the center frequencies thereof coincide with each other. FIG. 7 is a diagram showing an example in which the characteristics of the bandwidth with respect to the center frequency of the passband of the tunable band-pass filter 100 according to the related art shown in FIGS. 1 and 2 are simulated, and in the diagram, the horizontal axis represents a center frequency [GHz] of the passband and the vertical axis represents a 3 dB bandwidth [MHz] of the passband. The 3 dB bandwidth is a bandwidth at a point that has lowered by 3 dB from the peak of the passing waveform. Note that FIGS. 3 to 7 simulate a case in which the filter is designed under the conditions where the FRB (Full Ripple Band) is 200 [MHz] and the ripple is 0.01 [dB] when the number of stages of the filter is three and the center frequency is 11.0 [GHz], and the center frequency is varied.

As shown in FIGS. 3 to 7, it can be understood that when the center frequency of the passband of the tunable band-pass filter 100 according to the related art shown in FIGS. 1 and 2 is varied to fall between 10.6 [GHz] to 11.4 [GHz] (the amount of variation is 800 [MHz]), the bandwidth of the passband also fluctuates by as much as 118 [MHz].

Note that the problem that the bandwidth of the passband fluctuates largely when the center frequency of the passband is changed is considered to be a problem that is also inherent to the tunable band-pass filters disclosed in Patent Literatures 1 and 2.

An object of the present disclosure is to provide a tunable band-pass filter and a control method therefor that solve the aforementioned problems and can suppress fluctuations of a bandwidth of a passband when the center frequency of the passband is changed.

Solution to Problem

A tunable band-pass filter according to an aspect includes:

a waveguide;

a plurality of resonators configured to be accommodated in the waveguide and aligned in a longitudinal direction of the waveguide;

a dielectric plate configured to extend in the longitudinal direction of the waveguide so to be arranged adjacent to the plurality of resonators; and a metal pattern for coupling adjustment formed on the dielectric plate at a position corresponding to an interstage of the resonators, in which a distance between the dielectric plate and the resonators is variable.

A method for controlling a tunable band-pass filter according to another aspect includes:

accommodating a plurality of resonators in a waveguide in an aligned manner in a longitudinal direction of the waveguide;

arranging a dielectric plate configured to extend in the longitudinal direction of the waveguide so as to be adjacent to the plurality of resonators;

forming a metal pattern for coupling adjustment to the dielectric plate at a position corresponding to an interstage of the resonators; and making a distance between the dielectric plate and the resonators variable.

Advantageous Effects of Invention

According to the aforementioned aspects, an effect of providing a tunable band-pass filter and a control method therefor that can suppress fluctuations of a bandwidth of a passband when the center frequency of the passband is changed can be obtained.

DESCRIPTION OF EMBODIMENTS

Figure 1:
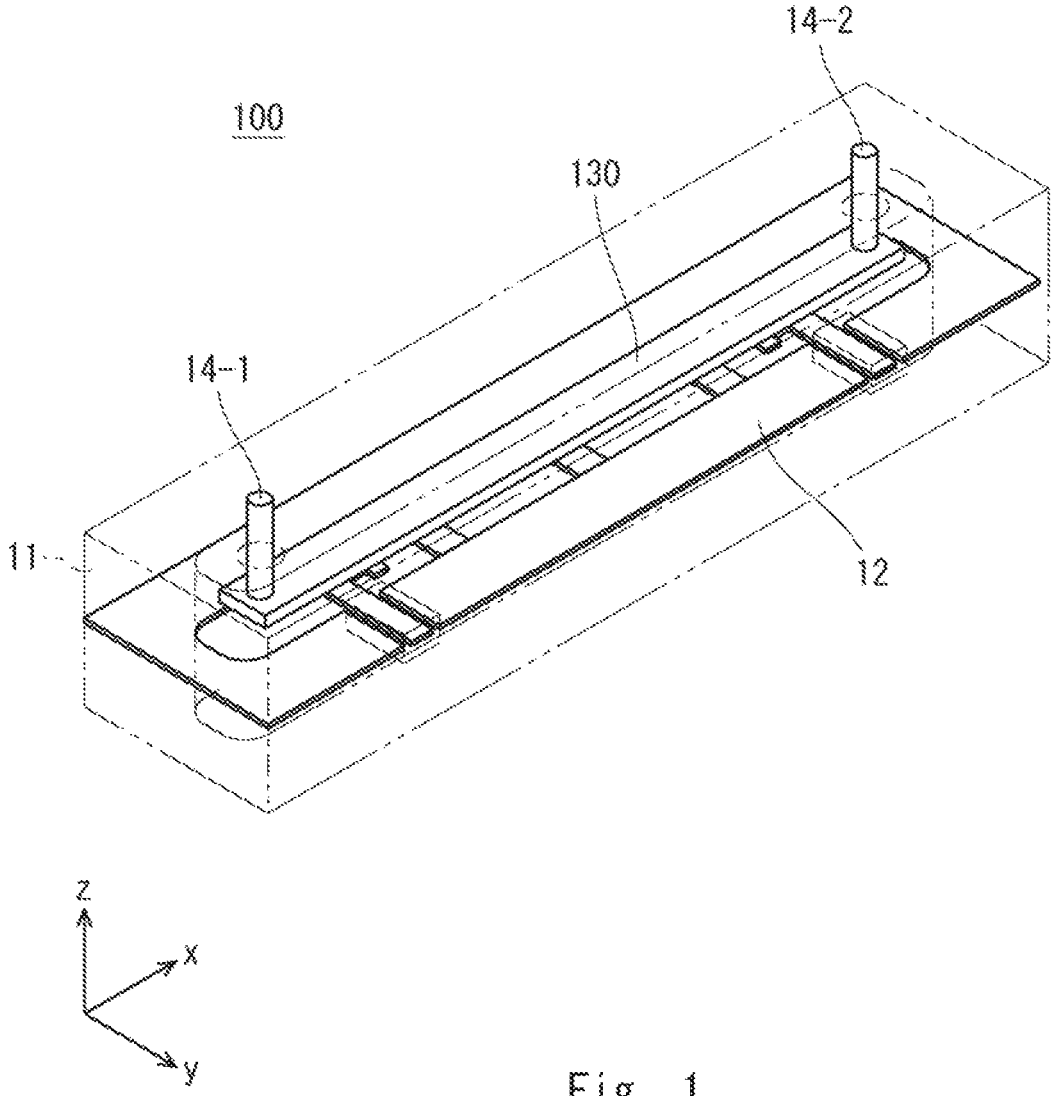
FIG. 1 is a perspective view showing an example of a configuration of a tunable band-filter according to a related art.

Hereinbelow, example embodiments of the present disclosure will be described with reference to the drawings. For clarifying the explanation, the following description and the drawings are partially omitted and simplified where appropriate. Further, the same reference symbols are assigned to the same elements in the drawings and duplicated explanations thereof are omitted where appropriate. Further, the specific values mentioned below are mere examples that are given for easy understanding of the disclosure and should not be limited thereto.

Outline of Each Example Embodiment

Figure 2:
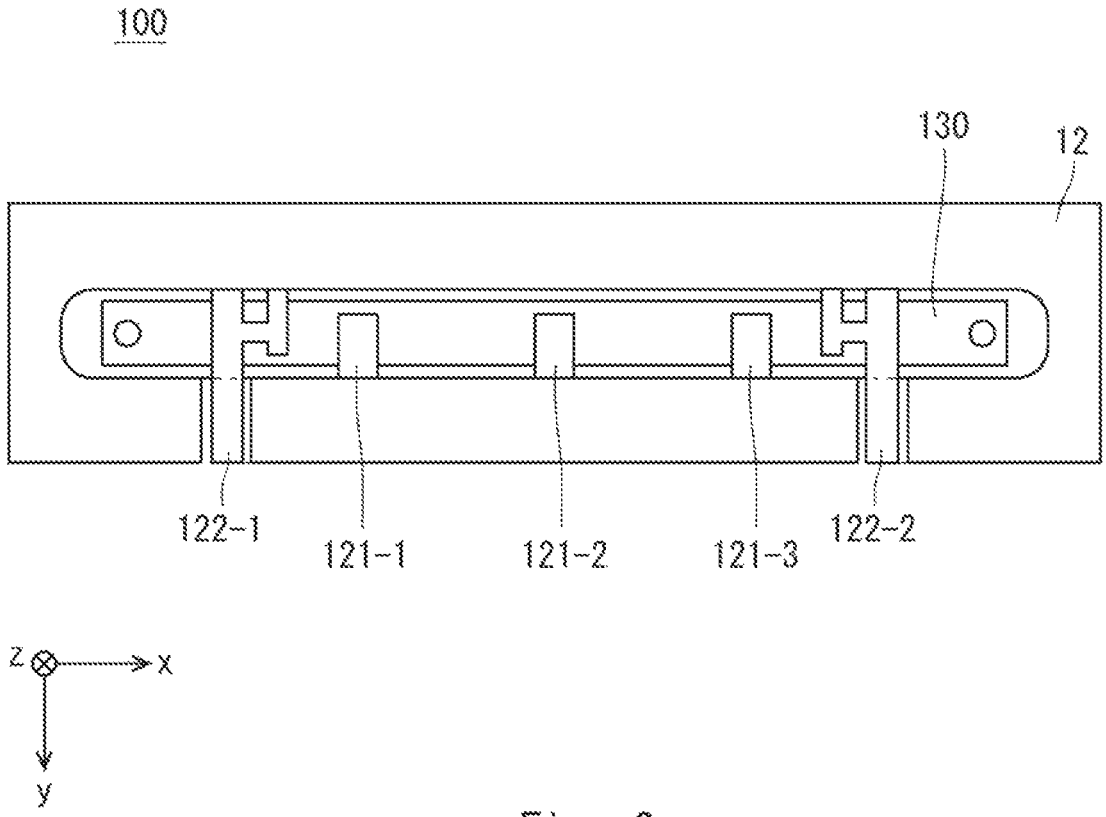
FIG. 2 is a bottom view showing an example of a configuration of the tunable band-pass filter according to the related art.
Figure 3:
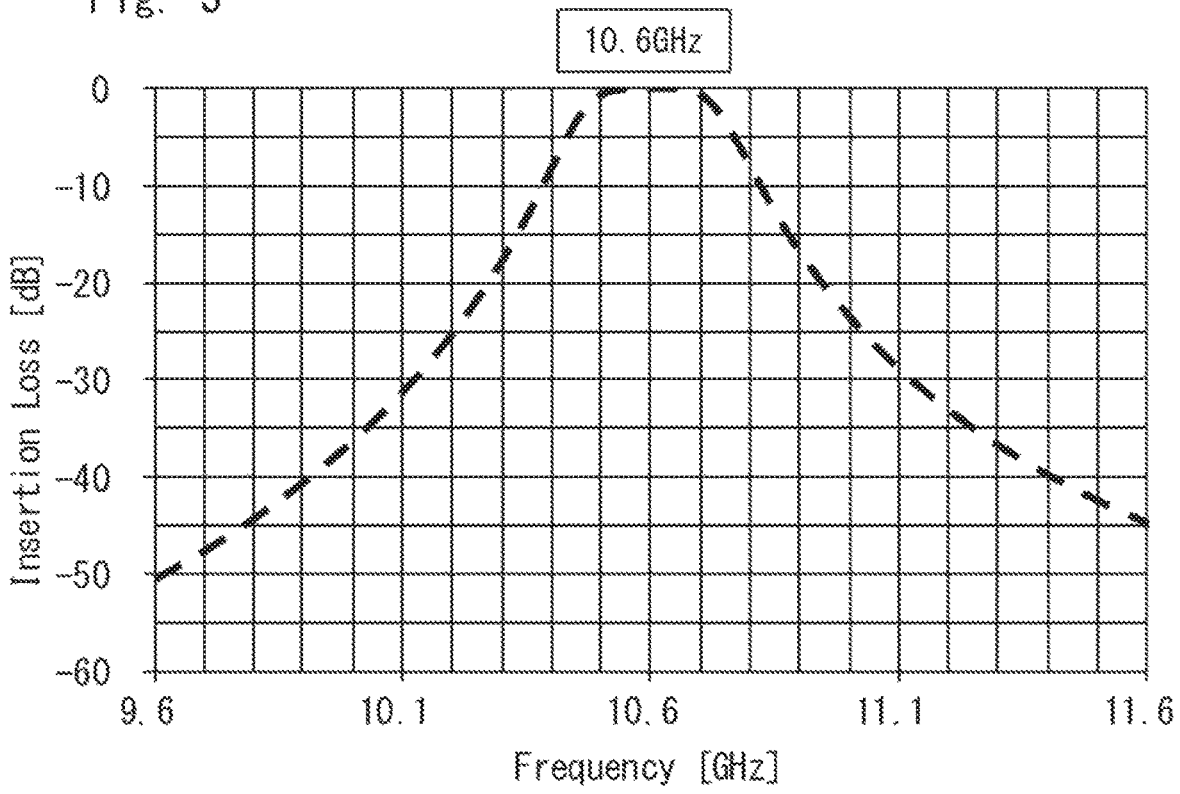
FIG. 3 is a diagram showing an example in which a passing waveform of the tunable band-pass filter according to the related art shown in FIGS. 1 and 2 is simulated.
Figure 4:
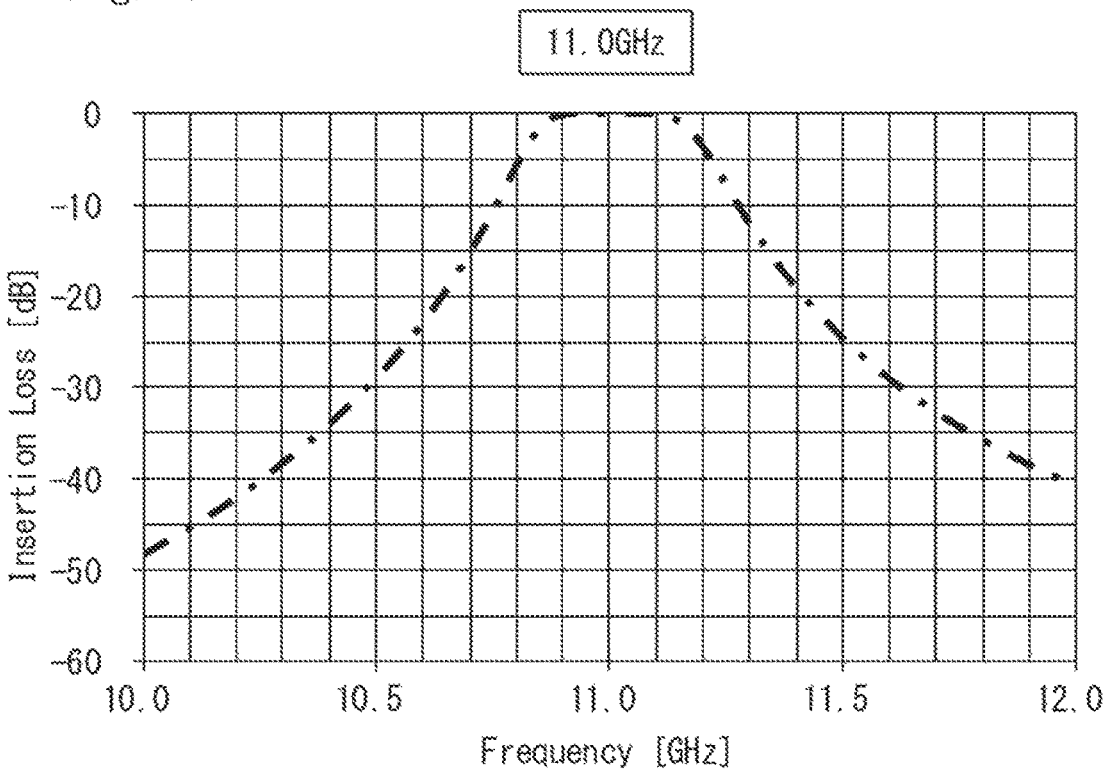
FIG. 4 is a diagram showing an example in which a passing waveform of the tunable band-pass filter according to the related art shown in FIGS. 1 and 2 is simulated.
Figure 5:
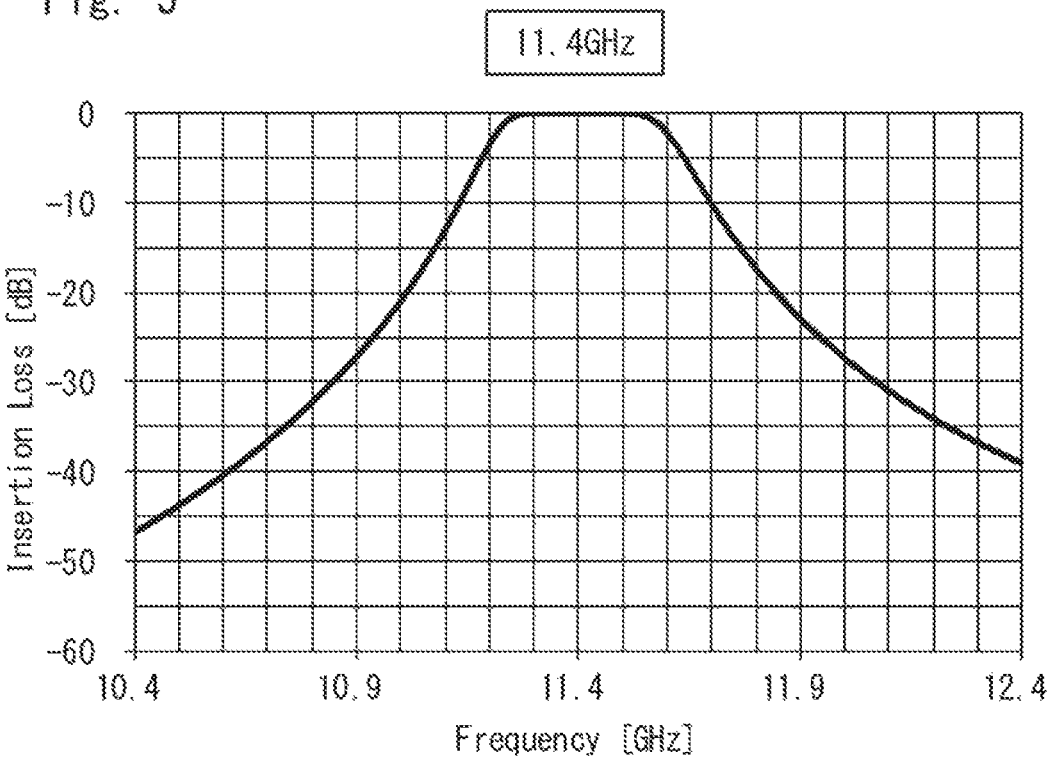
FIG. 5 is a diagram showing an example in which a passing waveform of the tunable band-pass filter according to the related art shown in FIGS. 1 and 2 is simulated.
Figure 6:
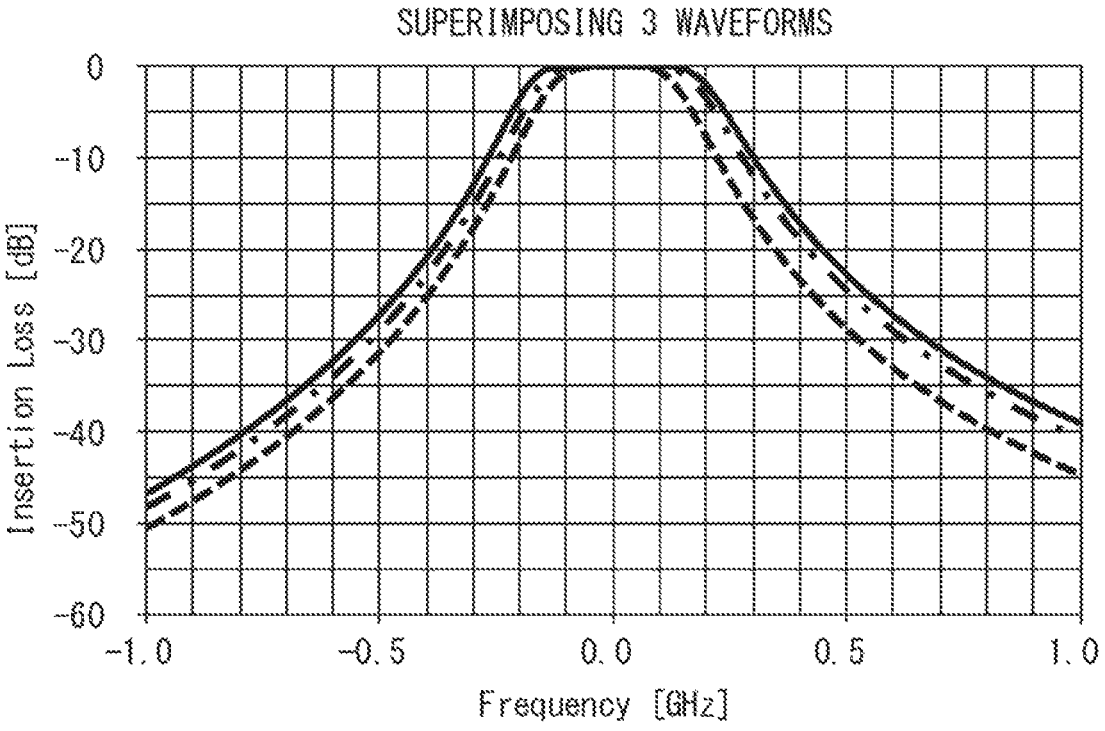
FIG. 6 is a diagram in which the three passing waveforms shown in FIGS. 3 to 5 are superimposed.
Figure 7:
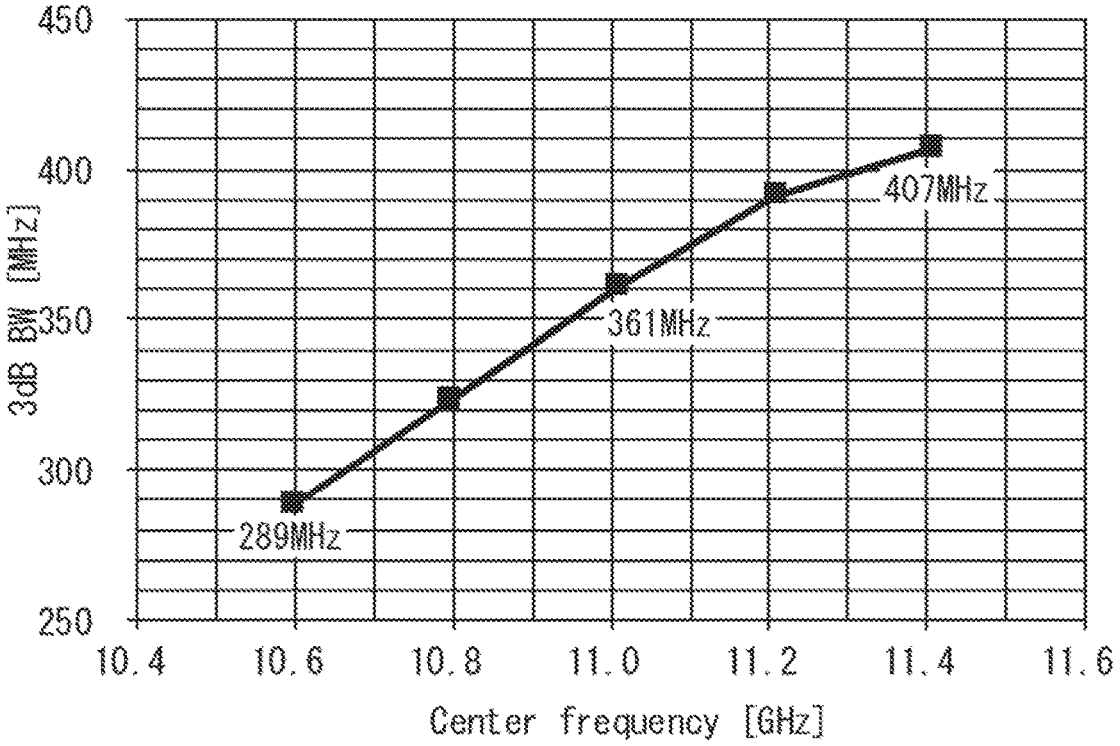
FIG. 7 is a diagram showing an example in which the characteristics of the bandwidth with respect to the center frequency of the passband of the tunable band-pass filter according to the related art shown in FIGS. 1 and 2 are simulated.
Figure 8:
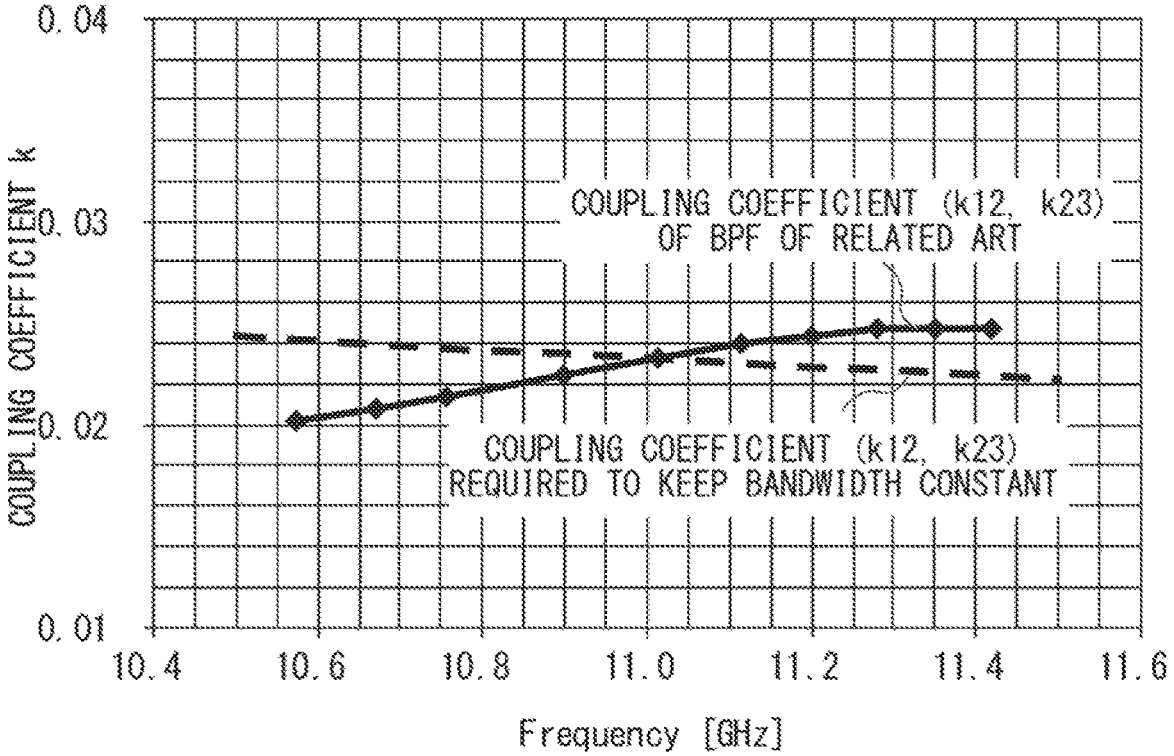
FIG. 8 is a diagram showing an example in which the characteristics of the coupling coefficient with respect to the center frequency of the passband of the tunable band-pass filter according to the related art shown in FIGS. 1 and 2 are simulated.

Firstly, summary of each example embodiment described below will be described. FIG. 8 is a diagram showing an example in which the characteristics of the coupling coefficient with respect to the center frequency of the passband of the tunable band-pass filter 100 according to the related art shown in FIGS. 1 and 2 are simulated, and in the diagram, the horizontal axis represents the center frequency [GHz] of the passband and the vertical axis represents the coupling coefficient. Here, the coupling coefficient indicates the coupling coefficient between the resonance plates 121, in which a coupling coefficient k12 indicates the coupling coefficient between the resonance plates 121-1 and 121-2 and a coupling coefficient k23 indicates the coupling coefficient between the resonance plates 121-2 and 121-3. Note that in FIG. 8, the simulation conditions are the same as those in FIGS. 3 to 7.

As shown in FIG. 8, the characteristics of the coupling coefficient with respect to the center frequency of the passband of the tunable band-pass filter 100 according to the related art shown in FIGS. 1 and 2 rise to the right, that is, the higher the center frequency, the higher the coupling coefficient becomes. Owing to this, it can be considered that the characteristics of the bandwidth with respect to the center frequency of the passband rise to the right as shown in FIG. 7, that is, the higher the center frequency, the wider the bandwidth becomes.

Therefore, in order to keep the bandwidth constant with respect to the center frequency of the passband, it is necessary to bring the characteristics of the coupling coefficient with respect to the center frequency of the passband to fall to the right along the dotted lines shown in FIG. 8, that is, the higher the center frequency, the lower the coupling coefficient becomes.

The tunable band-pass filter according to each example embodiment described below has a function of bringing the characteristics of the coupling coefficient with respect to the center frequency of the passband to fall to the right, that is, the higher the center frequency, the lower the coupling coefficient becomes.

First Example Embodiment

Figure 9:
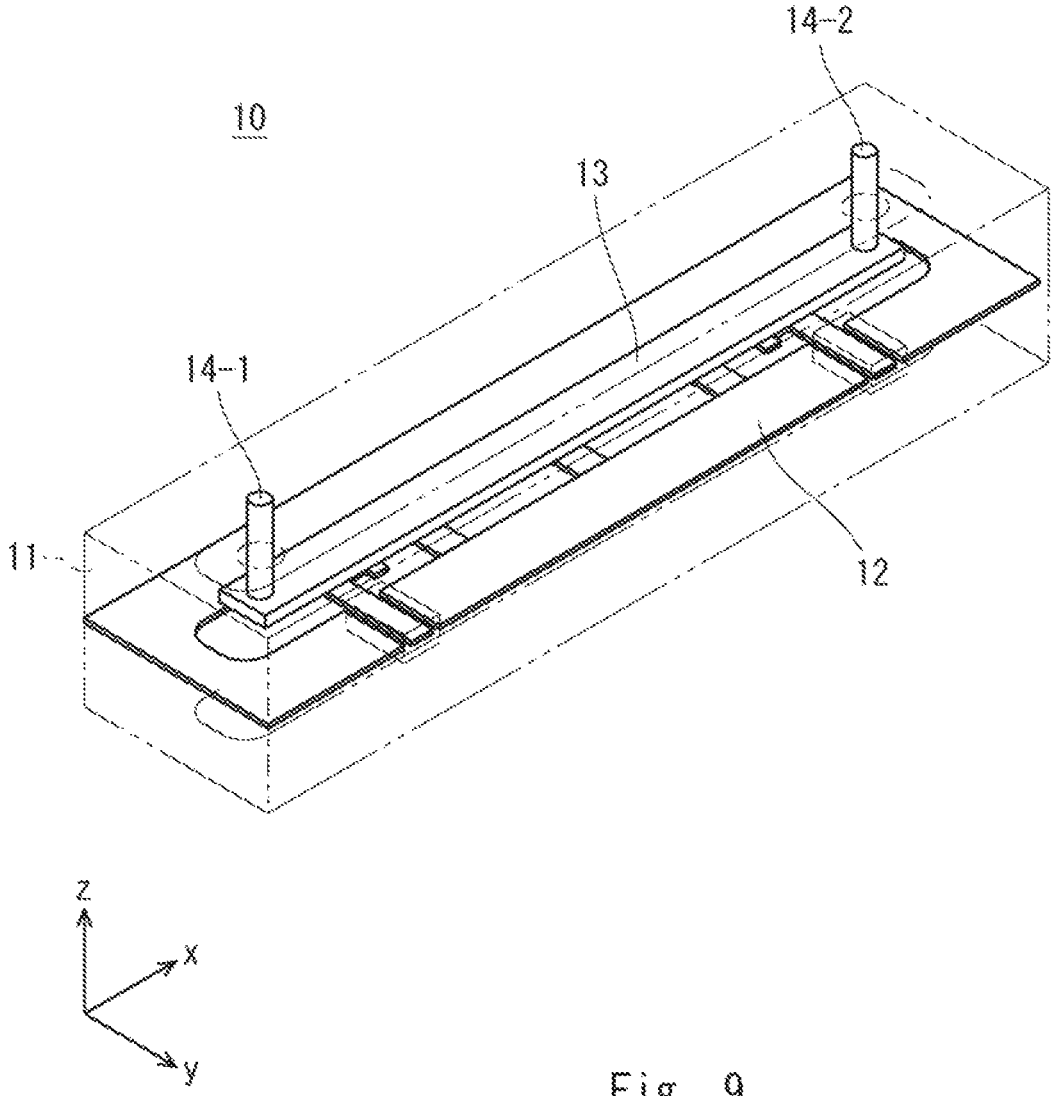
FIG. 9 is a perspective view showing an example of a configuration of a tunable band-pass filter according to a first example embodiment.
Figure 10:
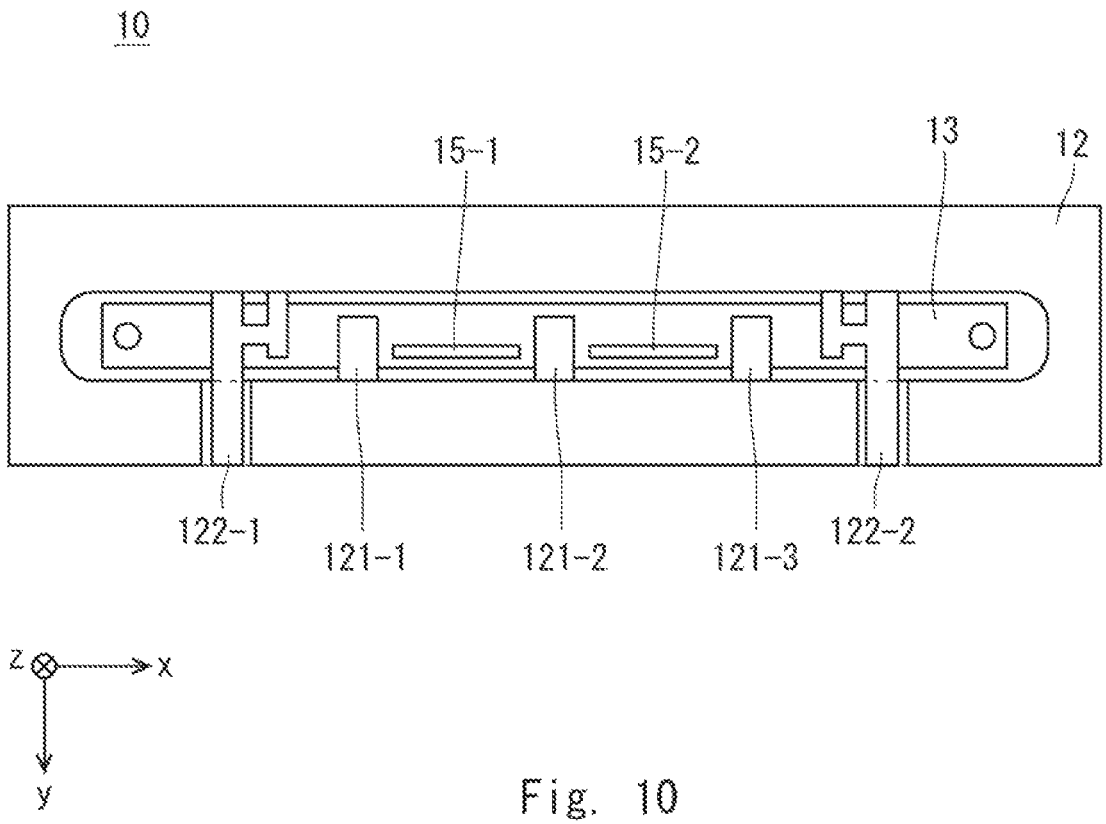
FIG. 10 is a bottom view showing an example of a configuration of the tunable band-pass filter according to the first example embodiment.
Figure 11:
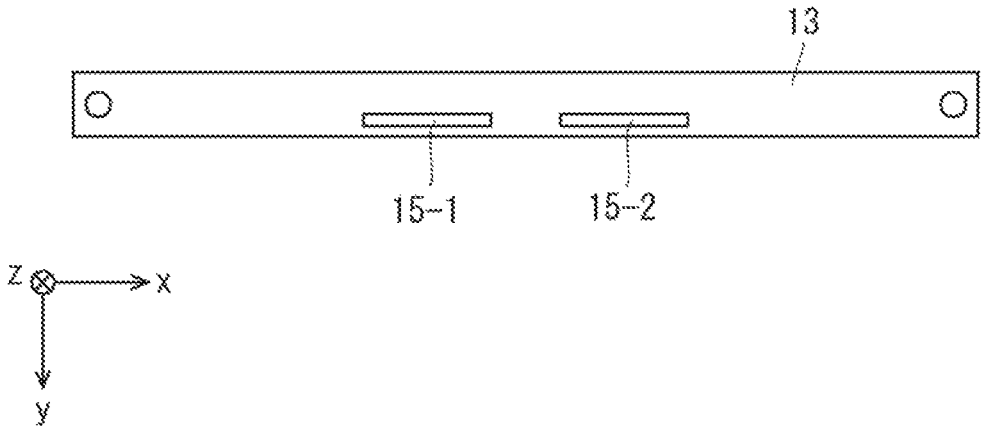
FIG. 11 is a bottom view showing an example of a configuration of a dielectric plate shown in FIGS. 9 and 10.

FIGS. 9 and 10 are diagrams showing an example of a configuration of a tunable band-pass filter 10 according to a first example embodiment, FIG. 9 being a perspective view and FIG. 10 being a bottom view. FIG. 11 is a bottom view showing an example of a configuration of a dielectric plate 13 shown in FIGS. 9 and 10.

As shown in FIGS. 9 to 11, the tunable band-pass filter 10 according to the first example embodiment differs from the tunable band-pass filter 100 according to the related art shown in FIGS. 1 and 2 in that the dielectric plate 13 on which metallic metal patterns 15-1 and 15-2 for coupling adjustment are formed is provided in place of the dielectric plate 130. Hereinbelow, when the metal patterns 15-1 to 15-2 are referred to without any particular distinction being made, they may be simply referred to as the "metal patterns 15".

The metal patterns 15-1 to 15-2 are formed on the main surface of either one of the two main surfaces of the dielectric plate 13 which faces the resonance plates 121 at a position corresponding to an interstage of the resonance plates 121. The metal pattern 15-1 is formed at a position corresponding to an interstage of the resonance plates 121-1 and 121-2, and the metal pattern 15-2 is formed at a position corresponding to an interstage of the resonance plates 121-2 and 121-3.

Figure 12:
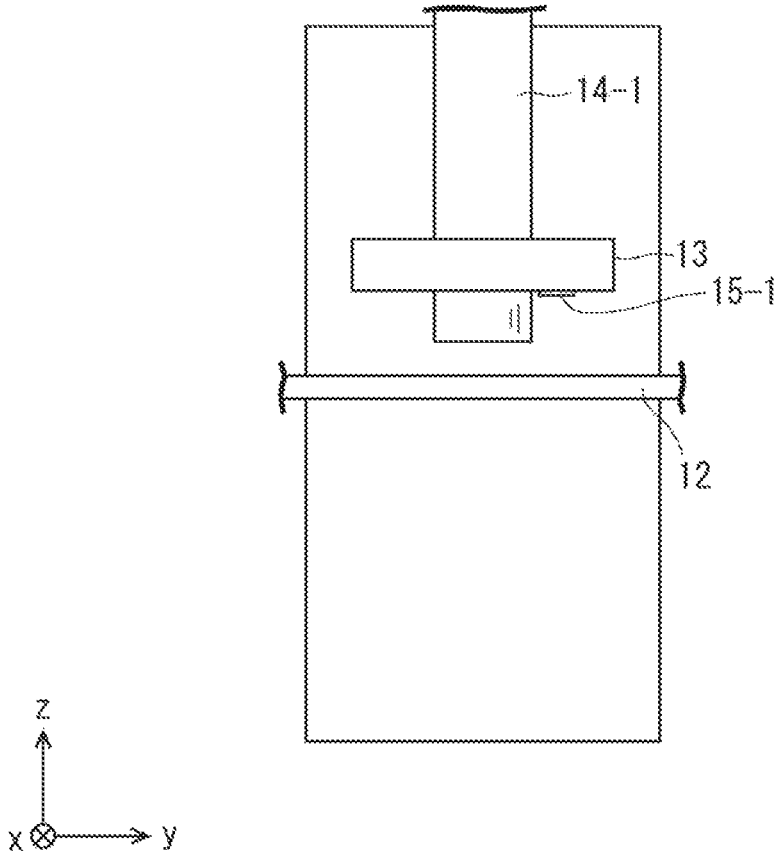
FIG. 12 is an enlarged side view showing an example of a configuration of the tunable band-pass filter according to the first example embodiment shown in FIGS. 9 and 10 in the vicinity of a metal pattern.
Figure 13:
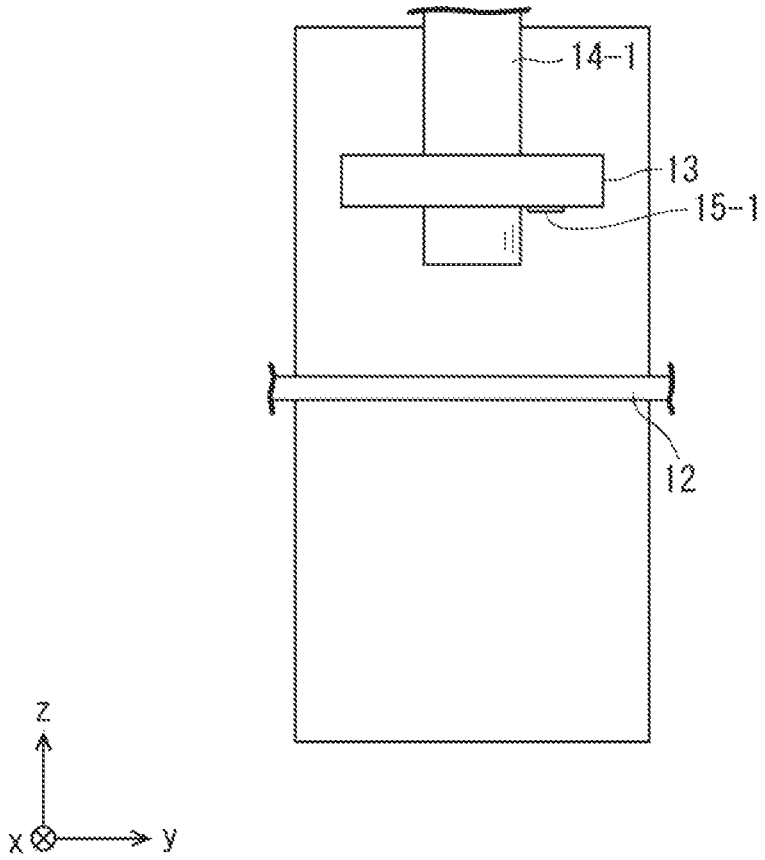
FIG. 13 is an enlarged side view showing an example of a configuration of the tunable band-pass filter according to the first example embodiment shown in FIGS. 9 and 10 in the vicinity of a metal pattern.

FIGS. 12 and 13 are enlarged side views showing an example of a configuration of the tunable band-pass filter 10 according to the first example embodiment shown in FIGS. 9 and 10 in the vicinity of the metal patterns 15. FIG. 12 shows a state in which the dielectric plate 13 has approached the resonance plates 121 (the metal plate 12) (a state in which the dielectric plate 13 has moved downward (the negative z-direction)), and FIG. 13 shows a state in which the dielectric plate 13 has receded from the resonance plates 121 (the metal plate 12) (a state in which the dielectric plate 13 has moved upward (the positive z-direction)).

Like the tunable band-pass filter 100 according to the related art, in the tunable band-pass filter 10 according to the first example embodiment, the closer the dielectric plate 13 approaches the resonance plates 121 (the metal plate 12), the lower the center frequency of the passband becomes, and the further the dielectric plate 13 recedes from the resonance plates 121 (the metal plate 12), the higher the center frequency of the passband becomes.

Therefore, in a state in which the dielectric plate 13 has approached the resonance plates 121 (the metal plate 12) as shown in FIG. 12, the center frequency of the passband becomes low. At this time, the metal patterns 15 formed on the dielectric plate 13 has also approached the resonance plates 121 (the metal plate 12). Accordingly, the coupling between the resonance plates 121 becomes strong through the metal patterns 15 formed at a position corresponding to the interstage of the resonance plates 121 and thus, the coupling coefficient becomes high.

Therefore, in a state in which the dielectric plate 13 has receded from the resonance plates 121 (the metal plate 12) as shown in FIG. 13, the center frequency of the passband becomes high. At this time, the resonance plates 121 (the metal plate 12) has also receded from the metal patterns 15 formed on the dielectric plate 13. Therefore, the coupling coefficient between the resonance plates 121 lowers since the influence of the metal patterns 15 on the coupling between the resonance plates 121 becomes weak.

As described above, the tunable band-pass filter 10 according to the first example embodiment can not only change the center frequency of the passband but can also change the coupling coefficient by moving the dielectric plate 13 in the vertical direction (the z-direction). Further, it is possible to bring the characteristics of the coupling coefficient with respect to the center frequency of the passband to fall to the right, that is, the higher the coupling coefficient, the lower the center frequency becomes.

Note that the metal patterns 15-1 and 15-2 can be formed at any position as long as they are formed at a position corresponding to the interstage of the resonance plates 121, and the position of the resonance plates 121 in the lengthwise direction (the y-direction) is not limited.

Figure 14:
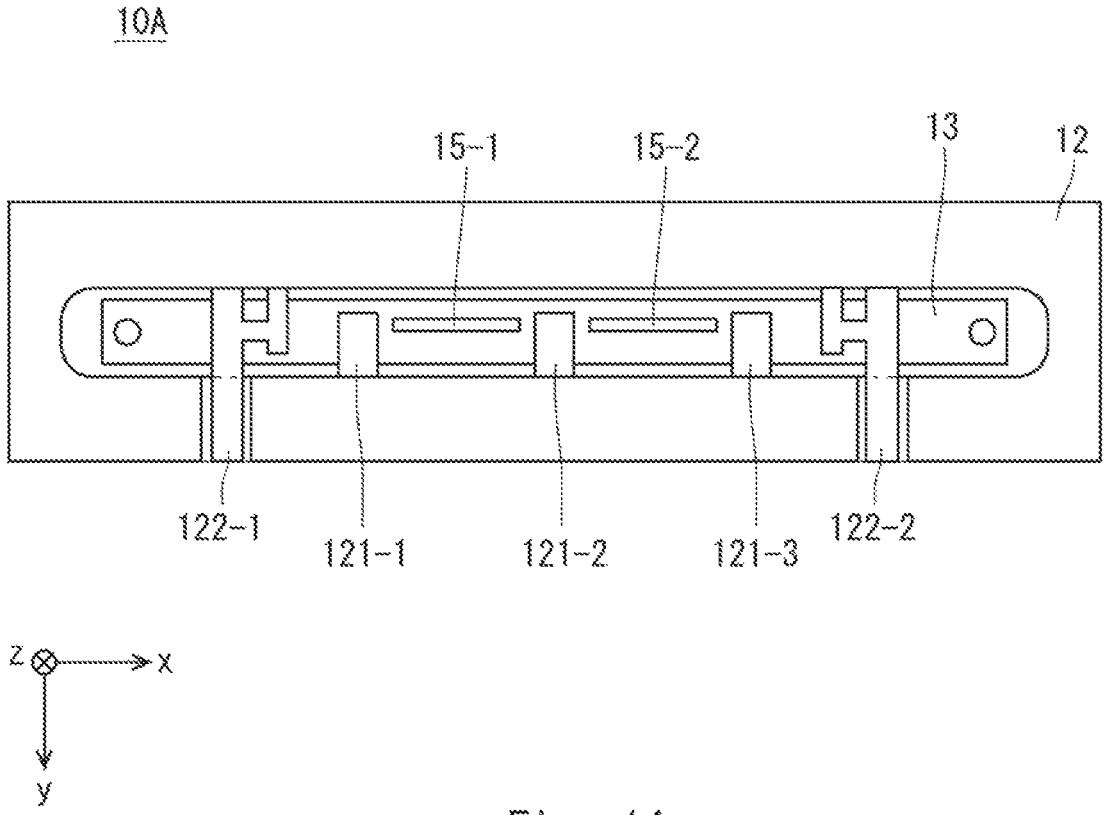
FIG. 14 is a bottom view showing an example of a configuration of a tunable band-pass filter as a modified example of the tunable band-pass filter according to the first example embodiment shown in FIGS. 9 and 10.

FIG. 14 is a bottom view showing an example of a configuration of a tunable band-pass filter 10A as a modified example of the tunable band-pass filter 10 according to the first example embodiment shown in FIGS. 9 and 10. In the tunable band-pass filter 10A shown in FIG. 14, the position of the metal patterns 15-1 and 15-2 in the y-direction is brought closer to the open end side (the negative y-direction side) of the resonance plates 121 compared to the case of the tunable band-pass filter 10 shown in FIGS. 9 and 10.

Figure 15:
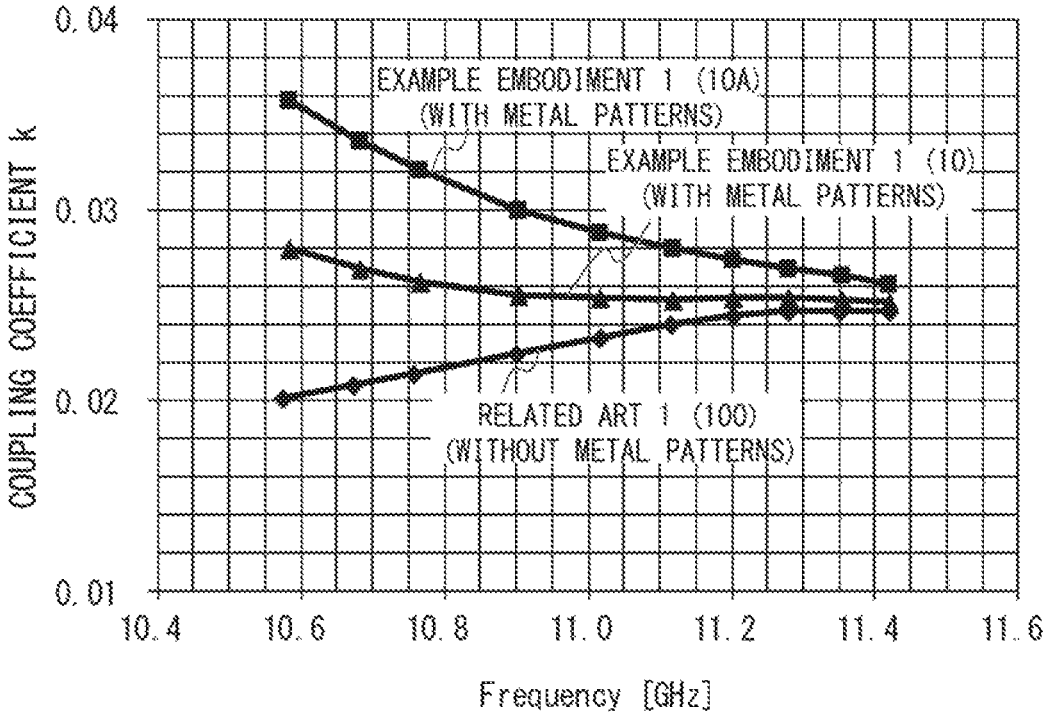
FIG. 15 is a diagram showing an example in which the characteristics of the coupling coefficient with respect to the center frequency of the passband of the tunable band-pass filter according to the first example embodiment shown in FIGS. 9 and 10 and the tunable band-pass filter according to the modified example of the first example embodiment shown in FIG. 14 are simulated.

FIG. 15 is a diagram showing an example in which the characteristics of the coupling coefficients with respect to the center frequencies of the passbands of the tunable band-pass filter 10 according to the first example embodiment shown in FIGS. 9 and 10 and the tunable band-pass filter 10A according to the modified example of the first example embodiment shown in FIG. 14 are simulated. Note that in FIG. 15, the characteristics of the tunable band-pass filter 100 according to the related art shown in FIGS. 1 and 2 are also shown for the sake of comparison. Further, in FIG. 15, the horizontal axis, the vertical axis, and the simulation conditions are the same as those in FIG. 8.

As shown in FIG. 15, it can be understood that the characteristics of the coupling coefficients with respect to the center frequencies of the passbands of the tunable band-pass filters 10 and 10A according to the first example embodiment fall to the right, that is, the higher the center frequencies, the lower the coupling coefficients become.

Further, comparing the characteristics of the tunable band-pass filters 10 and 10A, it can be understood that the closer the metal patterns 15-1 and 15-2 approach the open end side (the negative y-direction side) of the resonance plates 121, the steeper the inclination of the tunable band-pass filters become.

Figure 16:
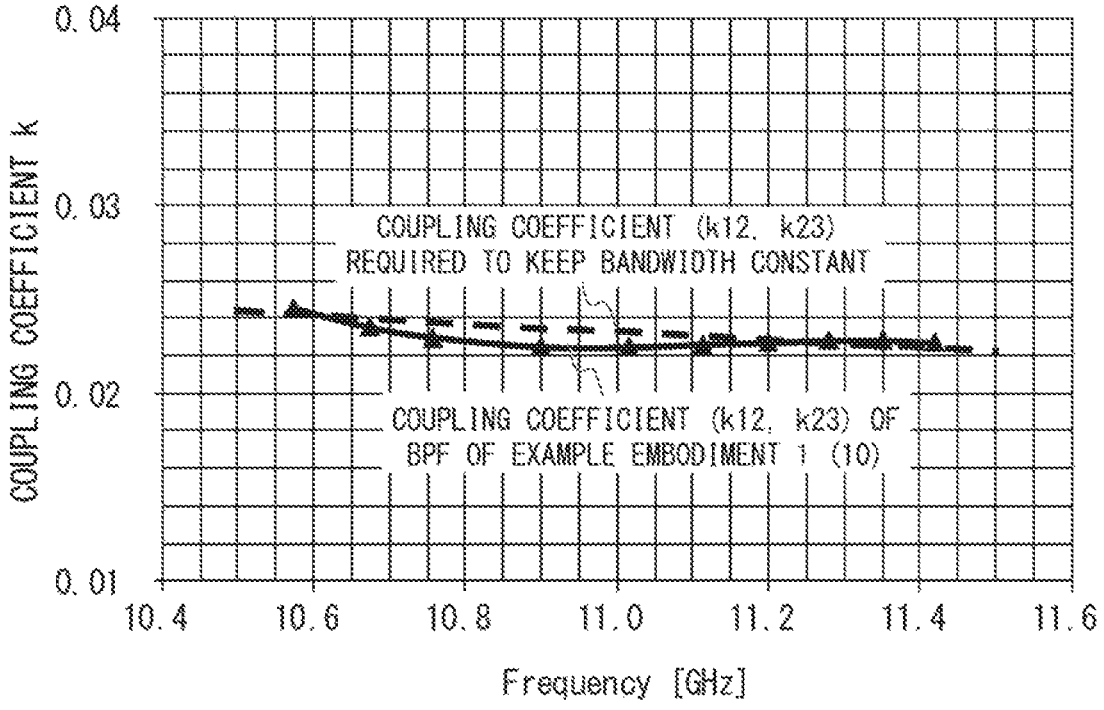
FIG. 16 is a diagram showing an example in which the characteristics of the coupling coefficient with respect to the center frequency of the passband of the tunable band-pass filter according to the first example embodiment shown in FIGS. 9 and 10 are compared with the characteristics of the coupling coefficient required to keep the bandwidth constant.

FIG. 16 is a diagram showing an example in which the characteristics of the coupling coefficient with respect to the center frequency of the passband of the tunable band-pass filter 10 according to the first example embodiment shown in FIGS. 9 and 10 are compared with the characteristics (the characteristics of the coupling coefficient required to keep the bandwidth constant) shown by the dotted lines in FIG. 8.

As shown in FIG. 16, although the characteristics of the coupling coefficient with respect to the center frequency of the passband of the tunable band-pass filter 10 according to the first example embodiment do not completely coincide with the characteristics shown by the dotted lines in FIG. 8, it can be understood that the deviation amount between the two characteristics is improved largely.

Figure 17:
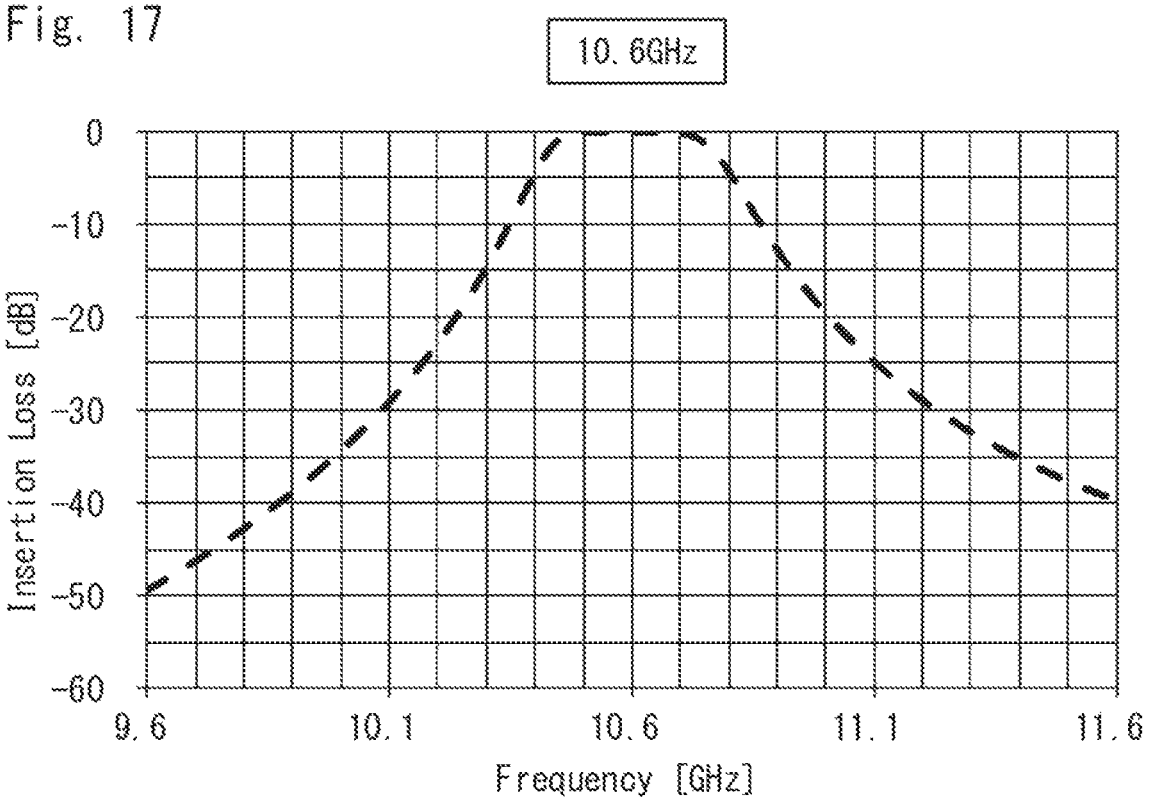
FIG. 17 is a diagram showing an example in which a passing waveform of the tunable band-pass filter according to the first example embodiment shown in FIGS. 9 and 10 is simulated.
Figure 18:
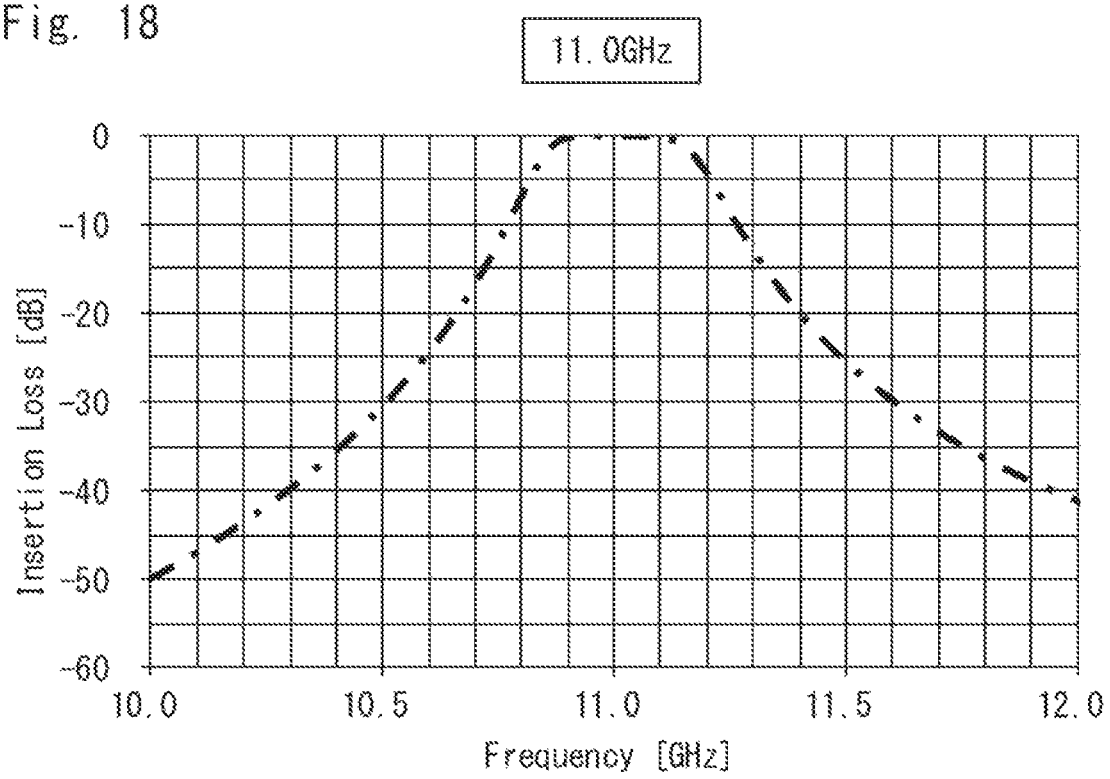
FIG. 18 is a diagram showing an example in which a passing waveform of the tunable band-pass filter according to the first example embodiment shown in FIGS. 9 and 10 is simulated.
Figure 19:
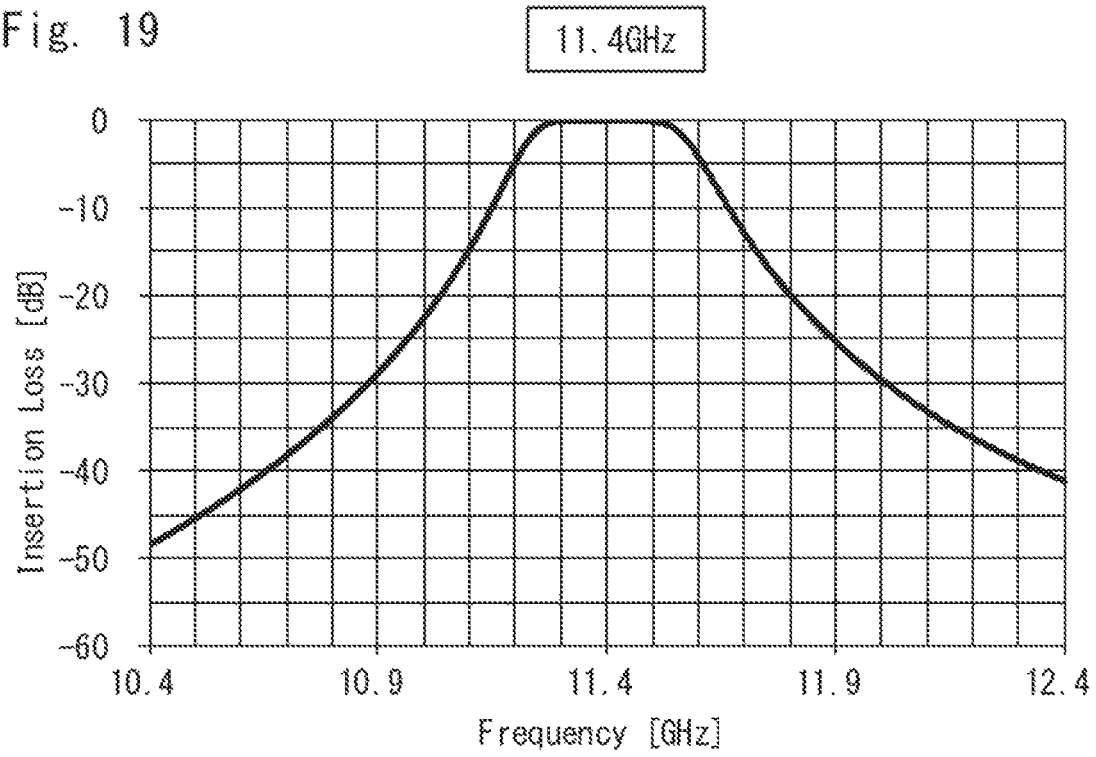
FIG. 19 is a diagram showing an example in which a passing waveform of the tunable band-pass filter according to the first example embodiment shown in FIGS. 9 and 10 is simulated.
Figure 20:
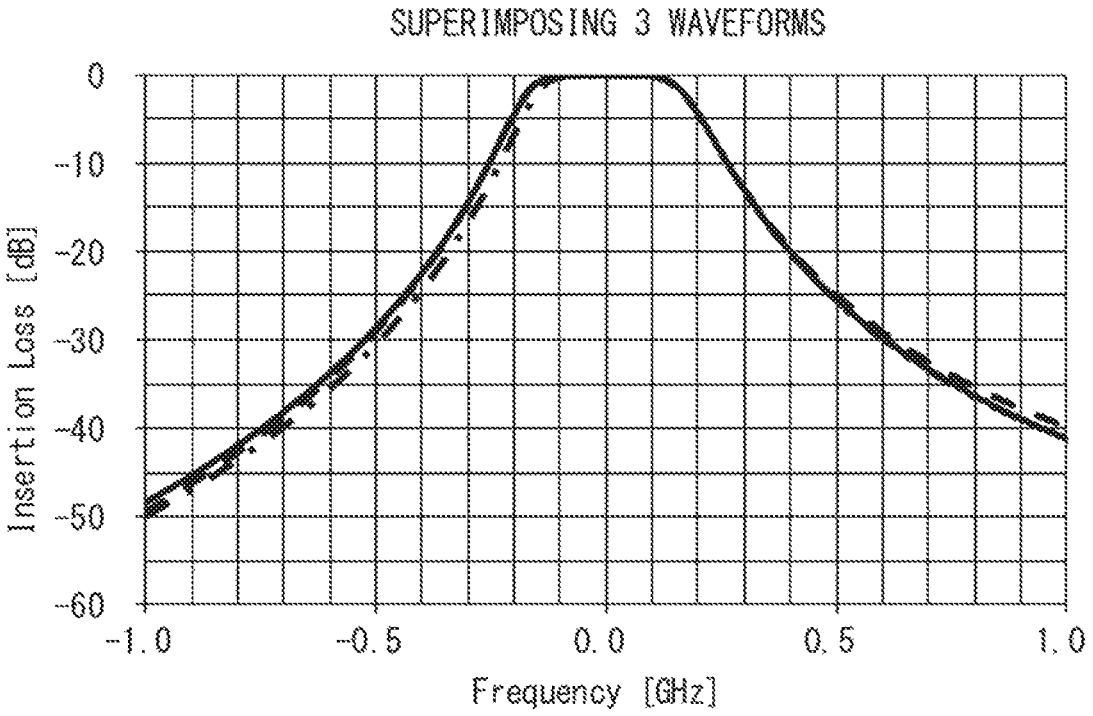
FIG. 20 is a diagram in which the three passing waveforms shown in FIGS. 17 to 19 are superimposed.
Figure 21:
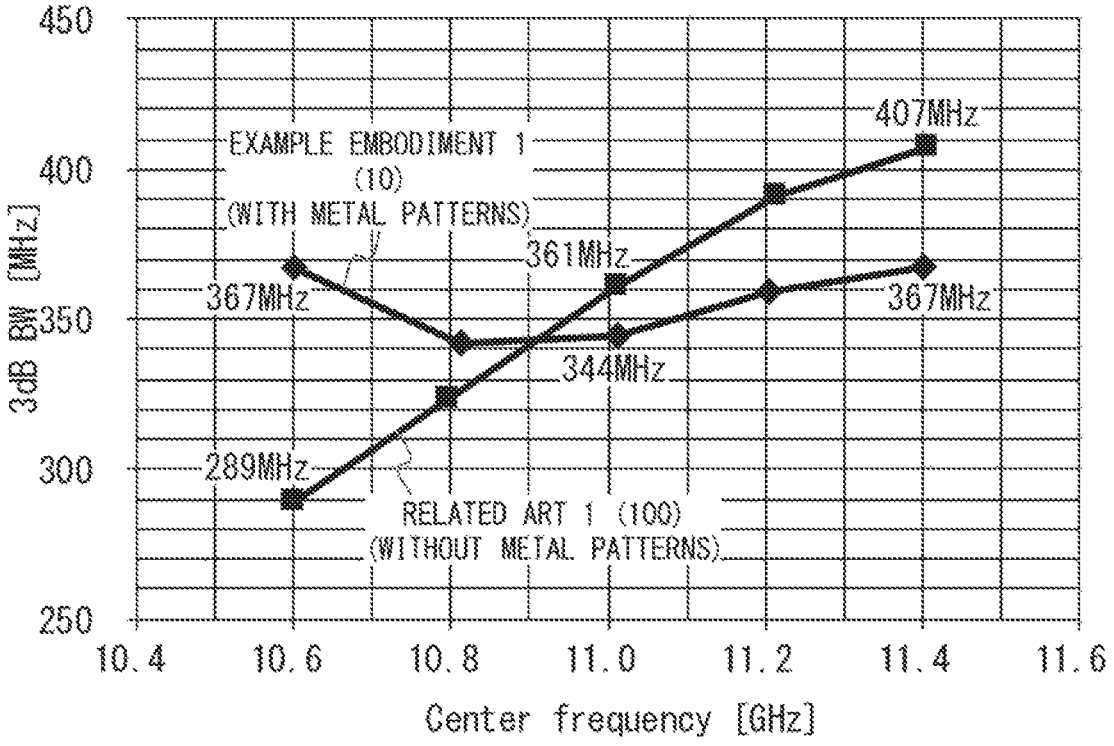
FIG. 21 is a diagram showing an example in which the characteristics of the bandwidth with respect to the center frequency of the passband of the tunable band-pass filter according to the first example embodiment shown in FIGS. 9 and 10 are simulated.

FIGS. 17 to 19 are diagrams showing examples in which the passing waveforms of the tunable band-pass filter 10 according to the first example embodiment shown in FIGS. 9 and 10 are simulated. FIGS. 17, 18, and 19 show the passing waveforms when the center frequency of the passband is 10.6 [GHz], 11.0 [GHz], and 11.4 [GHz], respectively. FIG. 20 is a diagram in which the three passing waveforms shown in FIGS. 17 to 19 are superimposed so that the center frequencies thereof coincide with each other. FIG. 21 is a diagram showing an example in which the characteristics of the bandwidth with respect to the center frequency of the passband of the tunable band-pass filter 10 according to the first example embodiment shown in FIGS. 9 and 10 are simulated. Note that in FIG. 21, the characteristics of the tunable band-pass filter 100 according to the related art shown in FIGS. 1 and 2 are also shown for the sake of comparison. Further, in FIGS. 17 to 21, the horizontal axis, the vertical axis, and the simulation conditions are the same as those shown in FIGS. 3 to 7, respectively.

As shown in FIG. 21, it can be understood that when the center frequency of the passband of the tunable band-pass filter 100 according to the related art is varied to fall between 10.6 [GHz] to 11.4 [GHz] (the amount of variation is 800 [MHz]), the bandwidth of the passband also fluctuates by as much as 118 [MHz].

On the other hand, as shown in FIGS. 17 to 21, even when the center frequency of the passband of the tunable band-pass filter 10 according to the first example embodiment is varied to fall between 10.6 [GHz] to 11.4 [GHz], the fluctuations of the bandwidth of the passband can be suppressed to 25 [MHz].

As described above, the tunable band-pass filters 10 and 10A according to the first example embodiment have the metal patterns 15 formed on the dielectric plate 13 that is arranged adjacent to the plurality of resonance plates 121 at a position corresponding to the interstage of the resonance plates 121.

The metal patterns 15 affect the coupling coefficient between the resonance plates 121. Specifically, in a state in which the dielectric plate 13 has approached the resonance plates 121, the center frequency of the passband becomes low and further, the coupling coefficient becomes high since the coupling between the resonance plates 121 becomes strong through the metal patterns 15. Further, in a state in which the dielectric plate 13 has receded from the resonance plates 121, the center frequency of the passband becomes high and further, the coupling coefficient lowers since the influence of the metal patterns 15 on the coupling between the resonance plates 121 becomes weak.

Therefore, the characteristics of the coupling coefficient with respect to the center frequencies of the passbands in the tunable band-pass filters 10 and 10A according to the first example embodiment fall to the right, that is, the higher the center frequencies, the lower the coupling coefficients become. Therefore, in the tunable band-pass filters 10 and 10A according to the first example embodiment, it is possible to suppress the fluctuations of the bandwidth of the passbands when the center frequencies of the passbands are changed.

Note that in the first example embodiment, the position of the metal patterns 15 in the lengthwise direction (the y-direction) of the resonance plates 121, the length (the x-direction) of the metal patterns 15, the shape of the metal patterns 15, etc. are not limited to those shown in FIGS. 9 to 14.

For example, the length (the x-direction) of the metal patterns 15 may be shorter than the length shown in FIGS. 9 to 14.

Further, the shape of the metal patterns 15 may be, for example, rectangular in addition to a liner shape along the longitudinal direction (the x-direction) of the waveguide 11 as shown in FIGS. 9 to 14.

Further, although the position of the metal patterns 15 in the longitudinal direction (the y-direction) of the resonance plates 121 is not particularly limited, it is preferably set at a position between the respective one ends of the resonance plates 121 which are connected to the metal plate 12 and the respective other ends thereof serving as the open ends.

Further, in the first example embodiment, the metal patterns 15 are formed on the main surface of the dielectric plate 13 which faces the resonance plates 121, although it is not limited thereto. The metal patterns 15 may instead be formed on the main surface of the dielectric plate 13 which is opposite to the main surface thereof facing the resonance plates 121. However, of the two main surfaces of the dielectric plate 13, the one in which the metal patterns 15 have a stronger influence on the coupling coefficient when the dielectric plate 13 approaches the resonance plates 121 is the main surface of the dielectric plate 13 which faces the resonance plates 121. Therefore, the metal patterns 15 are preferably formed on the main surface of the dielectric plate 13 which faces the resonance plates 121.

However, when the position of the metal patterns 15 in the y-direction, the length (the x-direction) of the metal patterns 15, the shape of the metal patterns 15, the main surface of the dielectric plate 13 on which the metal patterns 15 are formed, and the like are varied, the characteristics of the coupling coefficient with respect to the center frequency of the passband show variations such as change in the inclination. Therefore, the position of the metal patterns 15 in the y-direction, the length (the x-direction) of the metal patterns 15, the shape of the metal patterns 15, the main surface of the dielectric plate 13 on which the metal patterns 15 are formed, and the like may be determined as appropriate in accordance with the required center frequency, the bandwidth, etc., so that the characteristics of the coupling coefficient become the desired characteristics falling to the right.

Second Example Embodiment

The first example embodiment is an example in which the dielectric plate 13 is arranged so that the main surface of the dielectric plate 13 faces the main surface of the resonance plates 121, and the dielectric plate 13 is moved in the direction that is perpendicular to the main surface of the dielectric plate 13. On the other hand, the second example embodiment is an example in which the moving direction of the dielectric plate 13 differs from that in the first example embodiment.

Figure 22:
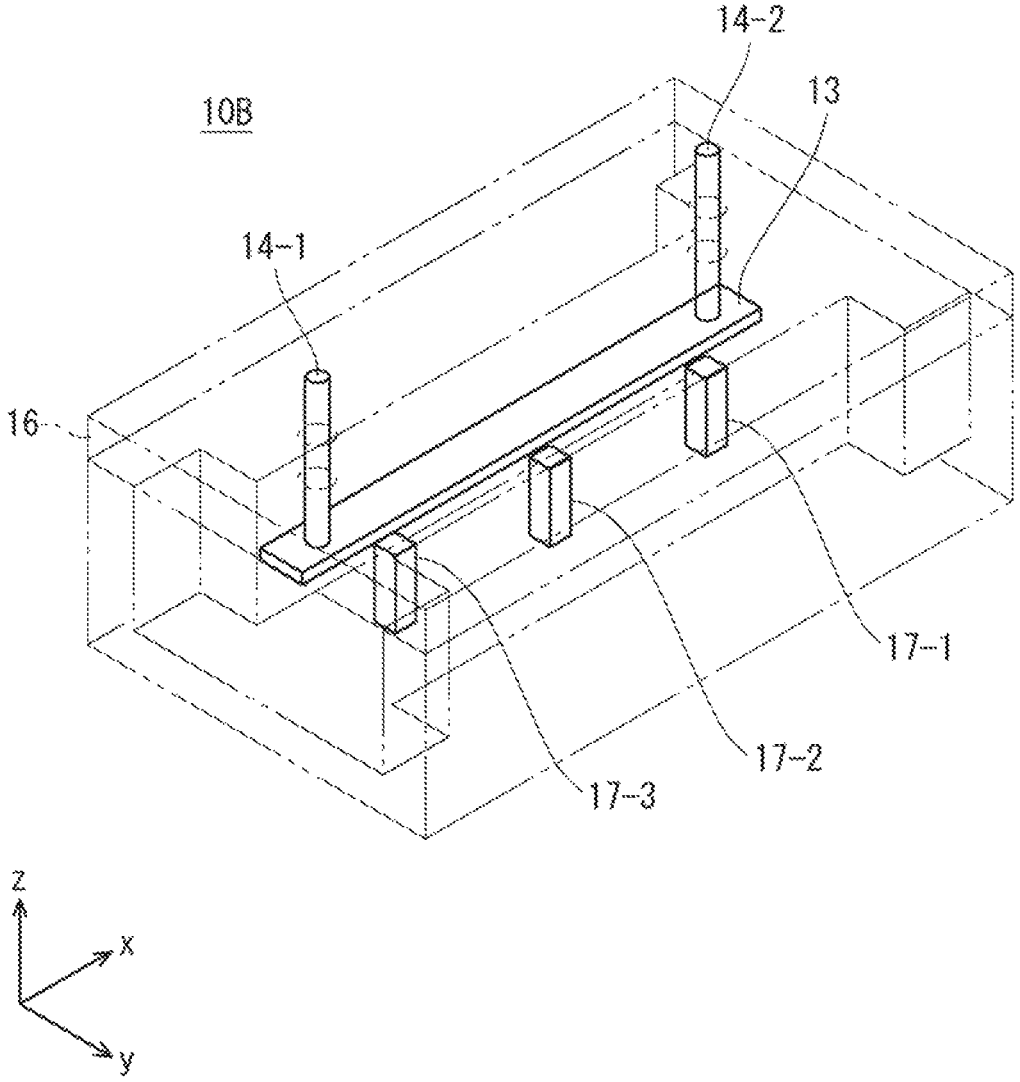
FIG. 22 is a perspective view showing an example of a configuration of a tunable band-pass filter according to a second example embodiment.
Figure 23:
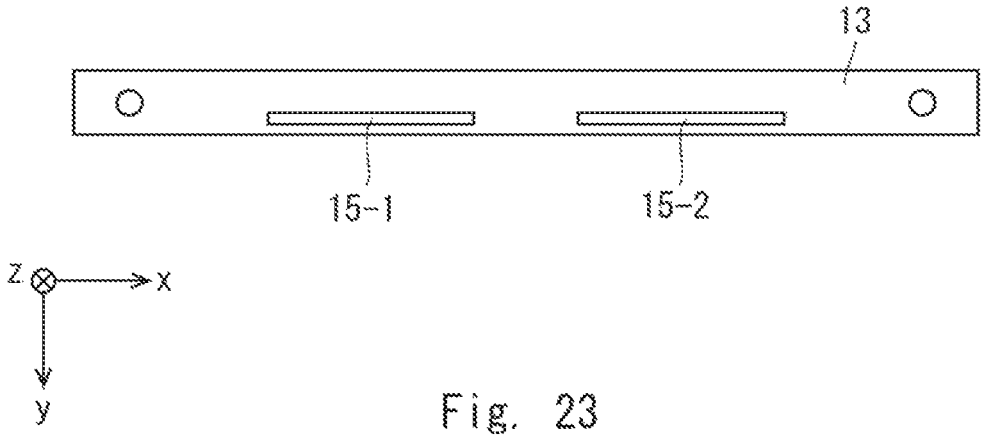
FIG. 23 is a bottom view showing an example of a configuration of a dielectric plate shown in FIG. 22.

FIG. 22 is a perspective view showing an example of a configuration of a tunable band-pass filter 10B according to the second example embodiment. FIG. 23 is a bottom view showing an example of a configuration of the dielectric plate 13 shown in FIG. 22

The tunable band-pass filter 10 according to the first example embodiment shown in FIGS. 9 and 10 has a configuration in which the plate-like resonance plates 121-1 to 121-3 are formed to the metal plate 12 held by the waveguide 11.

On the other hand, as shown in FIGS. 22 and 23, the tunable band-pass filter 10B according to the second example embodiment has a configuration in which rod-like resonance rods 17-1 to 17-3 are provided inside the waveguide 16. Hereinbelow, when the resonance rods 17-1 to 17-3 are referred to without any particular distinction being made, they may be simply referred to as the "resonance rods 17".

The resonance rods 17-1 to 17-3 are rod-like resonators having the respective one ends thereof (the negative z-direction side) connected to the bottom surface of the waveguide 16 and the respective other ends thereof (the positive z-direction side) being open ends (that is, they are not connected to other members). The resonance rods 17-1 to 17-3 are accommodated in the waveguide 16 and are aligned in the longitudinal direction (the x-direction) of the waveguide 16. The resonance rods 17-1 to 17-3 operate to resonate at a resonance frequency determined by the shape, the length (the z-direction), and the like.

The dielectric plate 13 extends in the longitudinal direction (the x-direction) of the waveguide 16 and is arranged adjacent to the resonance rods 17-1 to 17-3 so that the side surface of the dielectric plate 13 faces the side surfaces of the resonance rods 17-1 to 17-3.

The dielectric plate 13 moves in the vertical direction (the z-direction) by displacing the support rods 14-1 and 14-2 disposed at both ends in the x-direction of the dielectric plate 13 in the vertical direction (that is, the z-direction perpendicular to the main surface of the dielectric plate 13) using a stepping motor (not shown).

The metal patterns 15-1 to 15-2 are formed on the main surface of either one of the two main surfaces of the dielectric plate 13 which is the lower surface at a position corresponding to an interstage of the resonance rods 17. The metal pattern 15-1 is formed at a position corresponding to an interstage of the resonance rods 17-1 and 17-2, and the metal pattern 15-2 is formed at a position corresponding to an interstage of the resonance rods 17-2 and 17-3.

Figure 24:
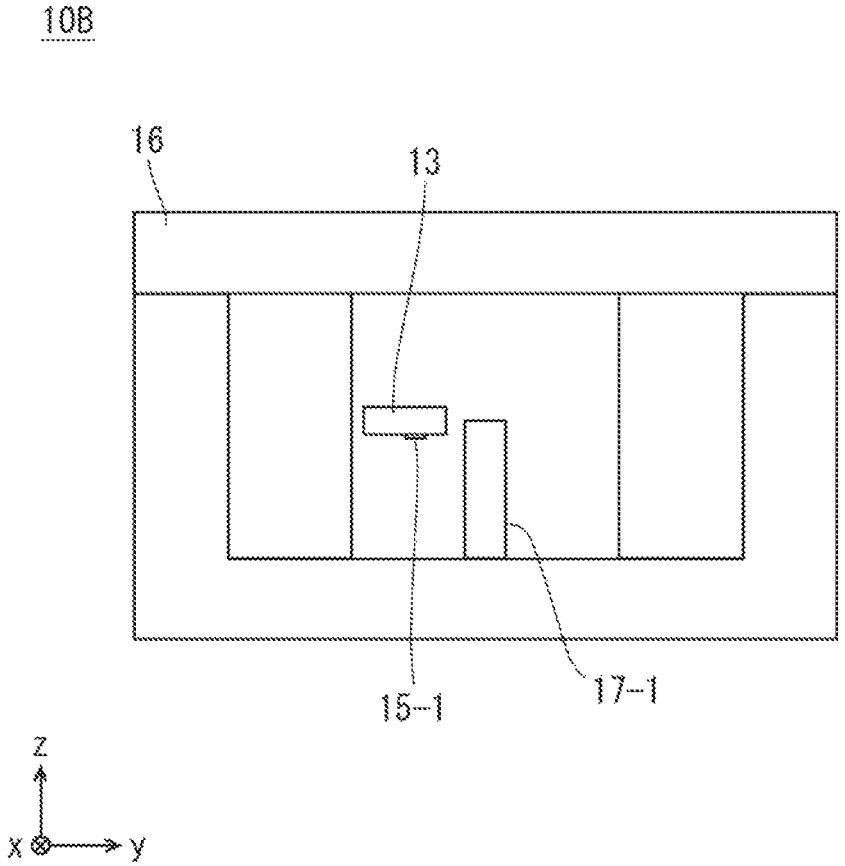
FIG. 24 is a side view showing an example of a configuration of the tunable band-pass filter according to the second example embodiment shown in FIG. 22.
Figure 25:
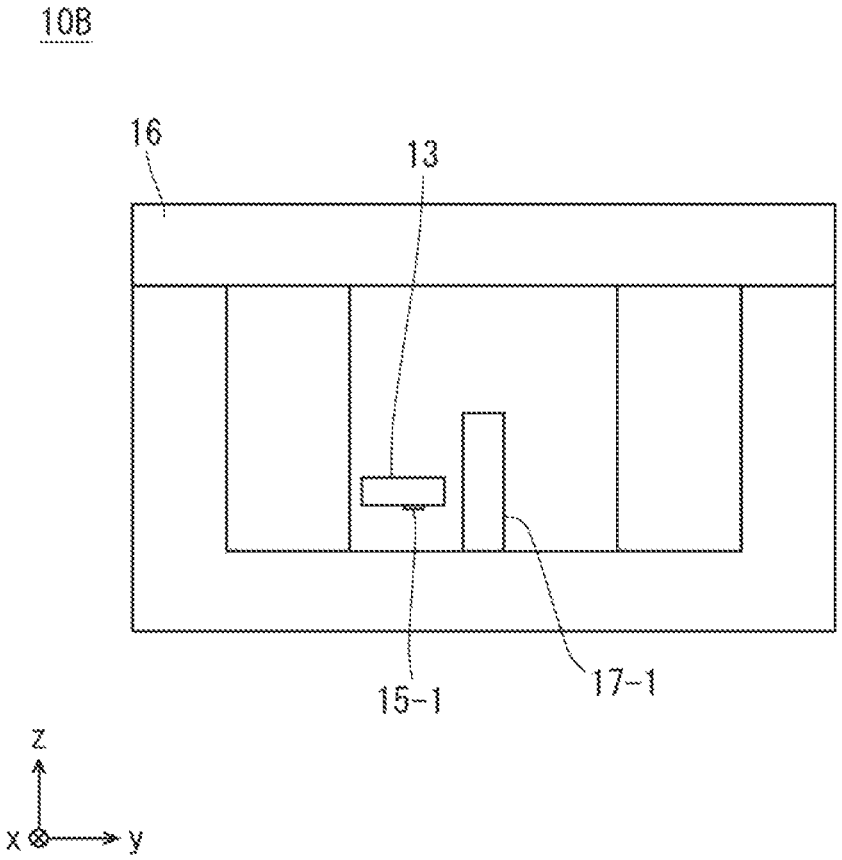
FIG. 25 is a side view showing an example of a configuration of the tunable band-pass filter according to the second example embodiment shown in FIG. 22.

FIGS. 24 and 25 are side views showing an example of a configuration of the tunable band-pass filter 10B according to the second example embodiment shown in FIG. 22. FIG. 24 shows a state in which the dielectric plate 13 has approached the open ends of the resonance rods 17 (a state in which the dielectric plate 13 has moved upward (the positive z-direction)), and FIG. 25 shows a state in which the dielectric plate 13 has receded from the open ends of the resonance rods 17 (a state in which the dielectric plate 13 has moved downward (the negative z-direction)).

In the tunable band-pass filter 10B according to the second example embodiment, the closer the dielectric plate 13 approaches the open ends of the resonance rods 17, the lower the center frequency of the passband becomes, and the further the dielectric plate 13 recedes from the open ends of the resonance rods 17, the higher the center frequency of the passband becomes.

Therefore, in a state in which the dielectric plate 13 has approached the open ends of the resonance rods 17 as shown in FIG. 24, the center frequency of the passband becomes low. At this time, the metal patterns 15 formed on the dielectric plate 13 has also approached the open ends of the resonance rods 17. Therefore, the coupling coefficient becomes high since the coupling between the resonance rods 17 becomes strong through the metal patterns 15 formed at a position corresponding to the interstage of the resonance rods 17.

On the other hand, in a state in which the dielectric plate 13 has receded from the open ends of the resonance rods 17 as shown in FIG. 25, the center frequency of the passband becomes high. At this time, the metal patterns 15 formed on the dielectric plate 13 has also receded from the open ends of the resonance rods 17. Therefore, the coupling coefficient between the resonance rods 17 lowers since the influence of the metal patterns 15 on the coupling between the resonance rods 17 becomes weak.

As described above, the characteristics of the coupling coefficient with respect to the center frequency of the passband in the tunable band-pass filter 10B according to the second example embodiment fall to the right, that is, the higher the center frequency, the lower the coupling coefficient becomes as in the first example embodiment.

Note that in the second example embodiment, the position of the metal patterns 15 in the y-direction, the length (the x-direction) of the metal patterns 15, the shape of the metal patterns 15, the main surface of the dielectric plate 13 on which the metal patterns 15 are formed, and the like are not limited to those shown in FIGS. 22 to 25, as in the first example embodiment.

Third Example Embodiment

The first example embodiment was an example of employing the tunable band-pass filter for a semi-coaxial filter or an evanescent mode filter. On the other hand, the third example embodiment is an example of employing the tunable band-pass filter for a TE (Transverse Electric) mode filter.

Figure 26:
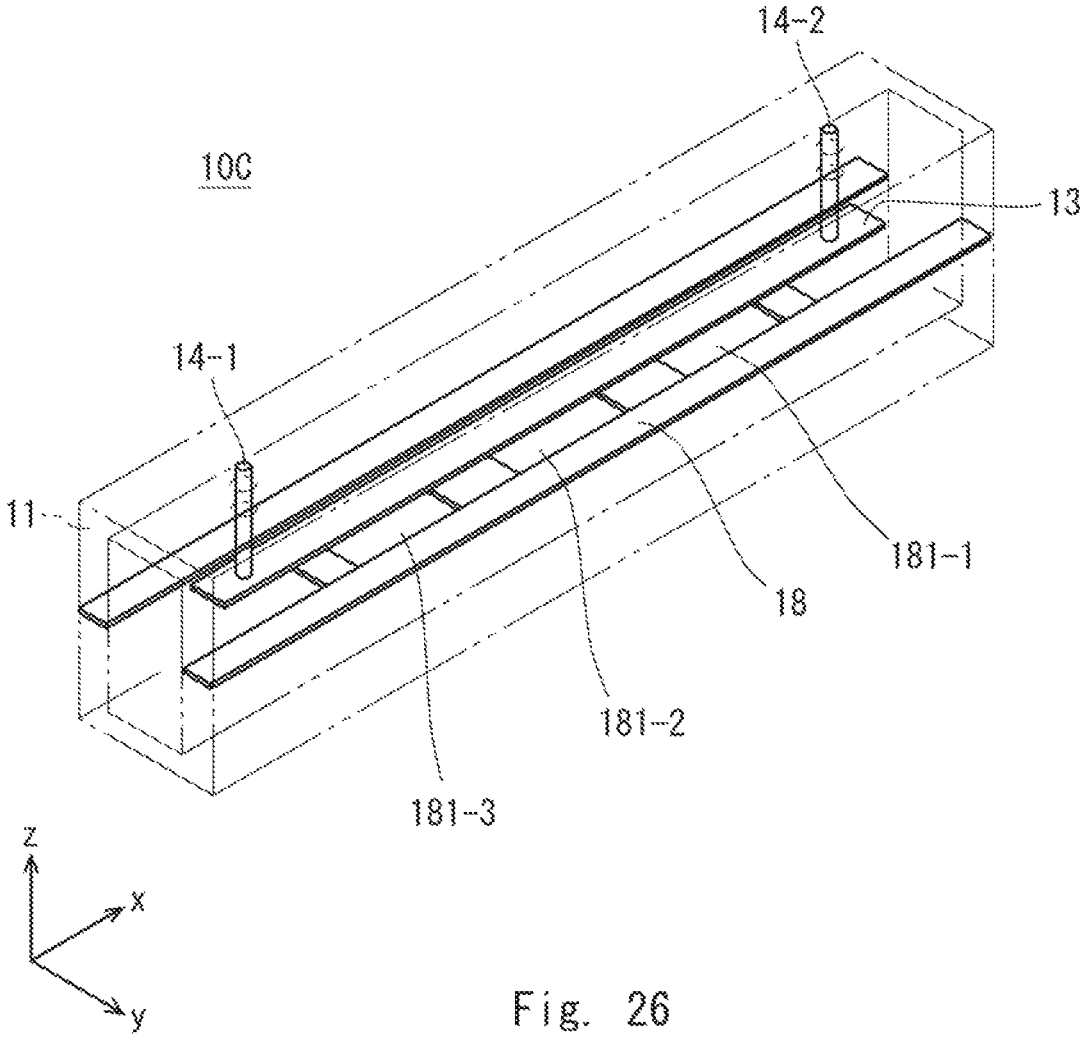
FIG. 26 is a perspective view showing an example of a configuration of a tunable band-pass filter according to a third example embodiment.
Figure 27:
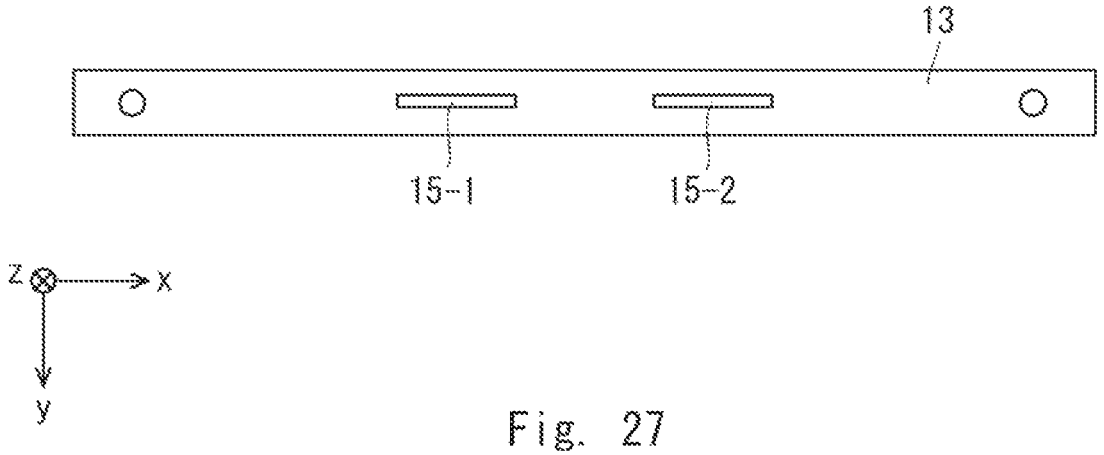
FIG. 27 is a bottom view showing an example of a configuration of a dielectric plate shown in FIG. 26.

FIG. 26 is a perspective view showing an example of a configuration of a tunable band-pass filter 10C according to a third example embodiment. FIG. 27 is a bottom view showing an example of a configuration of the dielectric plate 13 shown in FIG. 26.

As shown in FIGS. 26 and 27, the tunable band-pass filter 10C according to the third example embodiment differs from the tunable band-pass filter 10 according to the first example embodiment shown in FIGS. 9 and 10 in that a ladder-like metal plate 18 is provided in place of the metal plate 12.

The metal plate 18 is formed of a plate-like conductor and extends in the longitudinal direction (the x-direction) of the waveguide 11. The metal plate 18 has a ladder-like shape and cavity parts 181-1 to 181-3 thereof where no metal is present serve as the resonators. Hereinbelow, when the cavity parts 181-1 to 181-3 are referred to without any particular distinction being made, they may be simply referred to as the "cavity parts 181".

The dielectric plate 13 extends in the longitudinal direction (the x-direction) of the waveguide 16 and is arranged adjacent to the cavity parts 181-1 to 181-3 so that the main surface of the dielectric plate 13 faces the main surfaces of the cavity parts 181-1 to 181-3 (the metal plate 18).

The dielectric plate 13 moves in the vertical direction (the z-direction) by displacing the support rods 14-1 and 14-2 disposed at both ends in the x-direction of the dielectric plate 13 in the vertical direction (that is, the z-direction perpendicular to the main surface of the dielectric plate 13) using a stepping motor (not shown).

The metal patterns 15-1 to 15-2 are formed on the main surface of either one of the two main surfaces of the dielectric plate 13 which is the lower surface at a position corresponding to an interstage of the cavity parts 181. The metal pattern 15-1 is formed at a position corresponding to an interstage of the cavity parts 181-1 and 181-2, and the metal pattern 15-2 is formed at a position corresponding to an interstage of the cavity parts 181-2 and 181-3.

Figure 28:
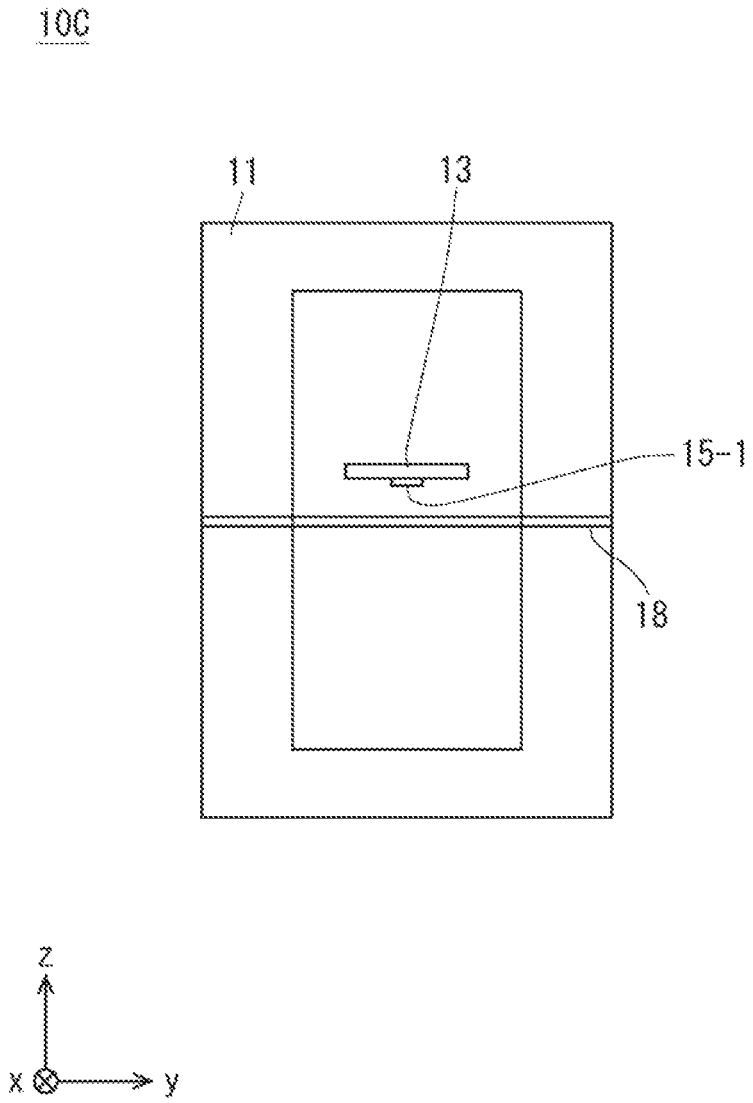
FIG. 28 is a side view showing an example of a configuration of the tunable band-pass filter according to the third example embodiment shown in FIG. 26.
Figure 29:
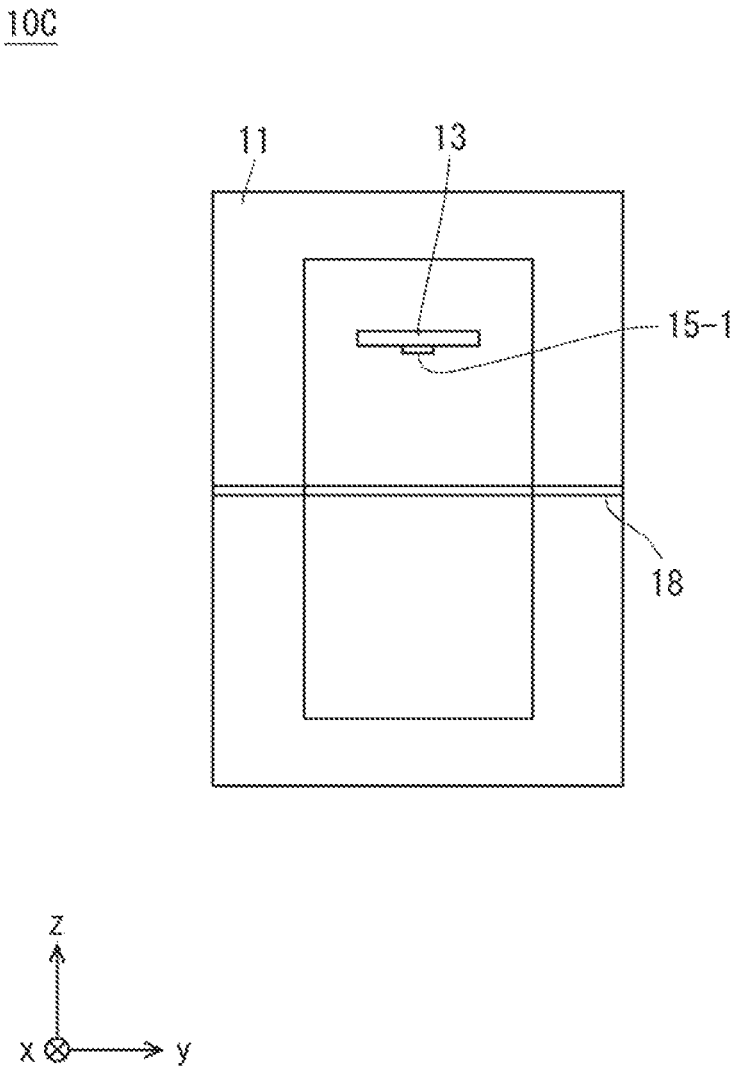
FIG. 29 is a side view showing an example of a configuration of the tunable band-pass filter according to the third example embodiment shown in FIG. 26.

FIGS. 28 and 29 are side views showing an example of a configuration of the tunable band-pass filter 10C according to the third example embodiment shown in FIG. 26. FIG. 28 shows a state in which the dielectric plate 13 has approached the cavity parts 181 (the metal plate 18) (a state in which the dielectric plate 13 has moved downward (the negative z-direction)), and FIG. 29 shows a state in which the dielectric plate 13 has receded from the cavity parts 181 (the metal plate 18) (a state in which the dielectric plate 13 has moved upward (the positive z-direction)).

In the tunable band-pass filter 10C according to the third example embodiment, the closer the dielectric plate 13 approaches the cavity parts 181 (the metal plate 18), the lower the center frequency of the passband becomes, and the further the dielectric plate 13 recedes from the cavity parts 181 (the metal plate 18), the higher the center frequency of the passband becomes.

Therefore, in a state in which the dielectric plate 13 has approached the cavity parts 181 (the metal plate 18) as shown in FIG. 28, the center frequency of the passband becomes low. At this time, the metal patterns 15 formed on the dielectric plate 13 has also approached the cavity parts 181 (the metal plate 18). Therefore, the coupling coefficient becomes high since the coupling between the cavity parts 181 becomes strong through the metal patterns 15 formed at a position corresponding to the interstage of the cavity parts 181.

On the other hand, in a state in which the dielectric plate 13 has receded from the cavity parts 181 (the metal plate 18) as shown in FIG. 29, the center frequency of the passband becomes high. At this time, the cavity parts 181 (the metal plate 18) has also receded from the metal patterns 15 formed on the dielectric plate 13. Therefore, the coupling coefficient between the cavity parts 181 lowers since the influence of the metal patterns 15 on the coupling between the cavity parts 181 becomes weak.

As described above, the characteristics of the coupling coefficient with respect to the center frequency of the passband in the tunable band-pass filter 10C according to the third example embodiment fall to the right, that is, the higher the center frequency, the lower the coupling coefficient becomes as in the first example embodiment.

Note that in the third example embodiment, the position of the metal patterns 15 in the y-direction, the length (the x-direction) of the metal patterns 15, the shape of the metal patterns 15, the main surface of the dielectric plate 13 on which the metal patterns 15 are formed, and the like are not limited to those shown in FIGS. 26 to 29, as in the first example embodiment.

The present disclosure has been described above with reference to the example embodiments. However, the present disclosure is not to be limited to the above-described example embodiments. Various modifications that can be understood by those skilled in the art within the scope of the present disclosure can be made to the configuration and the details of the present disclosure.

For example, in the above-described example embodiments, several examples of the moving direction of the dielectric plate have been given, however, in the present disclosure, the moving direction of the dielectric plate is not limited to these examples.

Further, in the above-described example embodiments, a semi-coaxial filter, an evanescent mode filter, and a TE mode filter have been given as examples of the tunable band-pass filter. However, in the present disclosure, the resonance mode of the filter is not limited to those of these examples. Other resonance modes (for example, TEM (Transverse Electro Magnetic) mode) are also applicable to the present disclosure.

REFERENCE SIGNS LIST

10, 10A, 10B, 10C TUNABLE BAND-PASS FILTER
11 WAVEGUIDE
12 METAL PLATE
121-1 to 121-3 RESONANCE PLATES
122-1 to 122-2 INPUT/OUTPUT PORTS
13, 130 DIELECTRIC PLATE
14-1 to 14-2 SUPPORT RODS
15-1 to 15-2 METAL PATTERNS
16 WAVEGUIDE
17-1 to 17-3 RESONANCE RODS
18 METAL PLATE
181-1 to 181-3 CAVITY PARTS

The invention claimed is:

1. A tunable band-pass filter comprising:
a waveguide;
a plurality of resonators configured to be accommodated in the waveguide and aligned in a longitudinal direction of the waveguide;
a dielectric plate configured to extend in the longitudinal direction of the waveguide so as to be arranged adjacent to the plurality of resonators; and
a metal pattern for coupling adjustment formed on the dielectric plate at a position corresponding to an interstage of the resonators,
wherein a distance between the dielectric plate and the resonators is variable.

2. The tunable band-pass filter according to claim 1, further comprising a metal plate extending in the longitudinal direction of the waveguide, wherein
the plurality of resonators are plate-like resonators formed to the metal plate,
the dielectric plate is arranged so that a main surface of the dielectric plate faces main surfaces of the plurality of resonators, and
the dielectric plate is configured to move in a direction perpendicular to the main surface of the dielectric plate.

3. The tunable band-pass filter according to claim 2, wherein
respective one ends of the plurality of resonators are connected to the metal plate and respective other ends thereof are open ends, and
the metal pattern is formed on the dielectric plate at a position corresponding to a position between the one ends connected to the metal plate and the other ends.

4. The tunable band-pass filter according to claim 2, wherein the metal pattern is formed on the main surface of the dielectric plate which faces the main surfaces of the plurality of resonators.

5. The tunable band-pass filter according to claim 1, wherein
the plurality of resonators are rod-like resonators,
the dielectric plate is arranged so that a side surface of the dielectric plate faces side surfaces of the plurality of resonators, and
the dielectric plate is configured to move in a direction perpendicular to a main surface of the dielectric plate.

6. The tunable band-pass filter according to claim 1, further comprising a ladder-like metal plate extending in the longitudinal direction of the waveguide, wherein
the plurality of resonators correspond to a part of the metal plate where no metal is present,
the dielectric plate is arranged so that a main surface of the dielectric plate faces main surfaces of the plurality of resonators, and
the dielectric plate is configured to move in a direction perpendicular to the main surface of the dielectric plate.

7. A method for controlling a tunable band-pass filter comprising:
accommodating a plurality of resonators in a waveguide in an aligned manner in a longitudinal direction of the waveguide;
arranging a dielectric plate configured to extend in the longitudinal direction of the waveguide so as to be adjacent to the plurality of resonators;
forming a metal pattern for coupling adjustment on the dielectric plate at a position corresponding to an interstage of the resonators; and
making a distance between the dielectric plate and the resonators variable.

* * * * *